US010360870B2

(12) United States Patent
Morita

(10) Patent No.: US 10,360,870 B2
(45) **Date of Patent: *Jul. 23, 2019**

(54) DISPLAY DRIVER, ELECTRO-OPTICAL DEVICE, AND ELECTRONIC APPARATUS

(71) Applicant: SEIKO EPSON CORPORATION, Tokyo (JP)

(72) Inventor: Akira Morita, Chin (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/665,713

(22) Filed: Aug. 1, 2017

(65) Prior Publication Data

US 2018/0047362 A1 Feb. 15, 2018

(30) Foreign Application Priority Data

Aug. 10, 2016 (JP) ..... 2016-157266

(51) Int. Cl.
*G09G 3/20* (2006.01)
*G09G 3/36* (2006.01)

(52) U.S. Cl.
CPC ..... *G09G 3/3688* (2013.01); *G09G 3/20* (2013.01); *G09G 3/2092* (2013.01); *G09G 2310/0275* (2013.01); *G09G 2320/0219* (2013.01)

(58) Field of Classification Search
CPC ..... G09G 2320/0219; G09G 3/2092; G09G 3/3688; G09G 3/3283; G09G 3/3291; G09G 3/3685; G09G 3/20; G09G 2310/0275; H03F 3/45179; G02B 6/0055; G02F 1/1368
See application file for complete search history.

(56) References Cited

U.S. PATENT DOCUMENTS

| | | | | |
|---|---|---|---|---|
| 6,011,533 | A | 1/2000 | Aoki | |
| 2004/0140972 | A1 * | 7/2004 | Hirota | G02B 6/0055 345/204 |
| 2009/0096818 | A1 * | 4/2009 | Nishimura | G09G 3/3291 345/690 |
| 2009/0135165 | A1 * | 5/2009 | Fukuzako | G09G 3/3283 345/204 |
| 2010/0182300 | A1 * | 7/2010 | Kato | G09G 3/3685 345/211 |
| 2012/0044275 | A1 | 2/2012 | Kobayashi | |
| 2015/0310822 | A1 * | 10/2015 | Saeki | H03F 3/45179 345/213 |
| 2016/0307536 | A1 * | 10/2016 | Okabe | G02F 1/1368 |

FOREIGN PATENT DOCUMENTS

| | | | |
|---|---|---|---|
| JP | 2001-324970 | A | 11/2001 |
| JP | 2006-071672 | A | 3/2006 |
| JP | 2010-276800 | A | 12/2010 |
| JP | 2012-042611 | A | 3/2012 |

* cited by examiner

*Primary Examiner* — Richard J Hong
(74) *Attorney, Agent, or Firm* — Oliff PLC

(57) ABSTRACT

A display driver includes a plurality of output terminals that output a plurality of data signals to an electro-optical panel, and a drive circuit including a plurality of drive units that output the plurality of data signals. Each drive unit includes an amplification circuit and a drive assistance circuit assisting drive performed by the amplification circuit. Drive assistance capability of the drive assistance circuit of an ith drive unit changes on the basis of gradation change information of a drive unit other than the ith drive unit.

18 Claims, 19 Drawing Sheets

DISPLAY DRIVER, ELECTRO-OPTICAL DEVICE, AND ELECTRONIC APPARATUS

BACKGROUND

1. Technical Field

The present invention relates to a display driver, an electro-optical device, and an electronic apparatus.

2. Related Art

A display driver of the related art includes a D/A conversion circuit that converts display data of each pixel into a voltage, and an amplification circuit that drives each pixel using a data voltage on the basis of the voltage. Since the amplification circuit performs a feedback control, the data voltage can be controlled to a target voltage although capacitances (for example, parasitic capacitances between data lines) of each data line are different from each other.

Recently, drive time per pixel is shortened due to advancement of a high definition electro-optical panel. For example, several to dozen pixels are driven at a time during phase development drive (for example, JP-A-2001-324970) in which several to dozen source lines are sequentially driven, and thus, high definition is achieved and the drive time per pixel is significantly shortened. If the drive time is shortened as such, drive capability of the amplification circuit needs to increase (settling time is shortened), but if the drive capability of the amplification circuit increases, accuracy of an output voltage decreases relatively. In order to achieve both, it is necessary to increase current consumption of the amplification circuit, but heat generation (temperature increase) of the display driver increases, and thus, it is difficult to achieve a high definition.

In order to solve the above problem, a method of performing drive without using feedback control, and thereafter, being set to a data voltage with high accuracy by an amplification circuit (or a method of performing only drive without using feedback control) is considered. For example, there is a method (digital assistance drive) of rapidly changing a data voltage to a target voltage by connecting an output terminal to a power supply during a predetermined period by using a transistor with drive capability according to a gradation difference between previous display data and next display data.

However, since the methods do not perform feedback control, there is a problem in which an error occurs between a data voltage that actually reaches and a target voltage due to capacitances (for example, parasitic capacitances between data lines) of each data line, and the display quality decreases (For example, display unevenness occurs). If the error between the data voltage and the target voltage is to be corrected by an amplification circuit, the amplification circuit requires drive capability for settling the data voltage in a short time, and as a result, power consumption of the amplification circuit increases.

In addition, since there is a case where a display driver is commonly used for various electro-optical panels, in a case where the display driver is used for various electro-optical panels, it is necessary to suppress a decrease in display quality caused by capacitances between data lines.

SUMMARY

An advantage of some aspects of the invention is to provide a display driver, an electro-optical device, and an electronic apparatus which can suppress a decrease in display quality caused by capacitances between data lines, depending on various electro-optical panel.

According to an aspect of the invention, there is provided a display driver including a plurality of output terminals that output a plurality of data signals which are output to an electro-optical panel, and a drive circuit that outputs the plurality of data signals to the plurality of output terminals, in which the drive circuit includes a plurality of drive units, in which each of the plurality of drive units includes an amplification circuit and a drive assistance circuit that assists drive which is performed by the amplification circuit, and in which the drive assistance circuit of an ith drive unit of the plurality of drive units changes drive assistance capability on the basis of gradation change information representing a gradation change of the drive unit other than the ith drive unit.

In the aspect of the invention, the drive circuit includes a plurality of drive units having drive assistance circuits for assisting drive performed by an amplification circuit, and the drive assistance capability of the drive assistance circuit of the given drive unit changes on the basis of gradation change information of other drive units. By doing so, the drive assistance circuit operates with the drive assistance capability for correcting an error caused by a gradation change in other drive units, and thereby, it is possible to suppress a decrease in display quality. In addition, although the error is caused by an electro-optical panel side connected to the display driver, a drive circuit on the display driver side can perform adjustment.

In addition, in the aspect of the invention, the drive assistance capability of the drive assistance circuit of the ith drive unit may decrease, in a case where a direction of the gradation change of a drive unit adjacent to the ith drive unit is the same as a direction of the gradation change of the ith drive unit.

By doing so, it is possible to appropriately correct an error due to a gradation change of an adjacent drive unit.

In addition, in the aspect of the invention, the drive assistance capability of the drive assistance circuit of the ith drive unit may increase, in a case where a direction of the gradation change of a drive unit adjacent to the ith drive unit is different from a direction of the gradation change of the ith drive unit.

By doing so, it is possible to appropriately correct an error due to a gradation change of an adjacent drive unit.

In addition, in the aspect of the invention, the drive assistance circuit of the ith drive unit may assist drive in accordance with a direction of the gradation change of a drive unit adjacent to the ith drive unit, in a case where the gradation change of the ith drive unit is zero.

By doing so, it is possible to appropriately correct an error due to a gradation change of an adjacent drive unit.

In addition, in the aspect of the invention, the drive assistance capability of the drive assistance circuit of the ith drive unit may change on the basis of a total sum of the gradation change information of the plurality of drive units.

By doing so, it is possible to appropriately correct an error due to overall gradation changes of a plurality of drive units.

In addition, in the aspect of the invention, the drive assistance capability of the drive assistance circuit of the ith drive unit may decrease, in a case where a direction of the gradation change that is represented by the total sum of the gradation change information is the same as a direction of the gradation change of the ith drive unit.

By doing so, it is possible to appropriately correct an error due to overall gradation changes of a plurality of drive units.

In addition, in the aspect of the invention, the drive assistance capability of the drive assistance circuit of the ith drive unit may increase, in a case where a direction of the gradation change that is represented by the total sum of the gradation change information is different from a direction of the gradation change of the ith drive unit.

By doing so, it is possible to appropriately correct an error due to overall gradation changes of a plurality of drive units.

In addition, in the aspect of the invention, the drive assistance circuit of the ith drive unit may assist drive in accordance with a direction of the gradation change that is represented by the total sum information of the gradation change information, in a case where the gradation change of the ith drive unit is zero.

By doing so, it is possible to appropriately correct an error due to overall gradation changes of a plurality of drive units.

In addition, in the aspect of the invention, the drive assistance circuit may assist such that an output of the drive circuit changes to a high potential side power supply voltage direction, in a case where a direction of the gradation change is in the high potential side power supply voltage direction, and the drive assistance circuit may assist such that an output of the drive circuit changes to a low potential side power supply voltage direction, in a case where a direction of the gradation change is in the low potential side power supply voltage direction.

By doing so, assistance of changing an output in a direction according to a gradation change direction is performed by a drive assistance circuit, and thus, it is possible to easily perform drive by using an amplification circuit.

In addition, in the aspect of the invention, the drive assistance circuit may include a first drive transistor group on the high potential side power supply voltage side and a second drive transistor group on the low potential side power supply voltage side, and the drive assistance circuit may change drive capability of the first drive transistor group on the basis of the gradation change information, in a case where a direction of the gradation change is the high potential side power supply voltage direction, and may change drive capability of the second drive transistor group on the basis of the gradation change information, in a case where a direction of the gradation change is in the low potential side power supply voltage direction.

By doing so, it is possible to perform assistance of changing an output in a direction according to a gradation change direction on the basis of two drive transistor groups.

In addition, in the aspect of the invention, the drive assistance circuit may perform a preliminary drive before being driven by the amplification circuit.

By doing so, it is possible to reduce an error between a voltage reaching a preliminary drive and a target voltage, and to reduce power consumption of an amplification circuit.

In addition, in the aspect of the invention, a control circuit that performs calculation processing on the basis of the gradation change information and sets the drive assistance capability of the drive assistance circuit may be further included.

By doing so, it is possible to perform calculation processing for drive assistance capability based on a gradation change direction by using a control circuit.

In addition, in the aspect of the invention, the electro-optical panel may include a sample and hold circuit that samples and holds a plurality of video signals which are the plurality of data signals, and the plurality of output terminals may be connectable to one terminal of the sample and hold circuit.

In a case where the sample and hold circuit is included, if there is an error between a voltage and a target voltage at a timing when the voltage is held in a source line, display unevenness occurs. At this point, according to the aspect of the invention, the error can be reduced by adjusting drive assistance capability, and thus, it is possible to reduce the display unevenness.

In addition, according to another aspect of the invention, an electro-optical device includes the display driver described at any one of the above descriptions, and the electro-optical panel.

In addition, according to still another aspect of the invention, the electro-optical panel may include a sample and hold circuit that samples and holds a plurality of video signals which are the plurality of data signals and a plurality of input terminals that are connected to the plurality of output terminals of the display driver, the sample and hold circuit may include a plurality of transistors, each having a drain that is connected to a pixel and a source that is connected to any one input terminal of the plurality of input terminals, and the plurality of transistors may include a first transistor having a source and drain which are arranged in this sequence in a first direction of the electro-optical panel and a second transistor that are adjacent to the first transistor in the first direction and has a source and drain which are arranged in this sequence in the first direction.

In addition, according to still another aspect of the invention, the display driver described in any one of the above descriptions is included in an electronic apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, preferred embodiments of the invention will be described in detail. The embodiments which will be described below do not unduly limit the content of the invention described in the claims, and all the configurations described in the embodiments are not indispensable as solution means for the invention.

1. Display Driver

Figure 1:
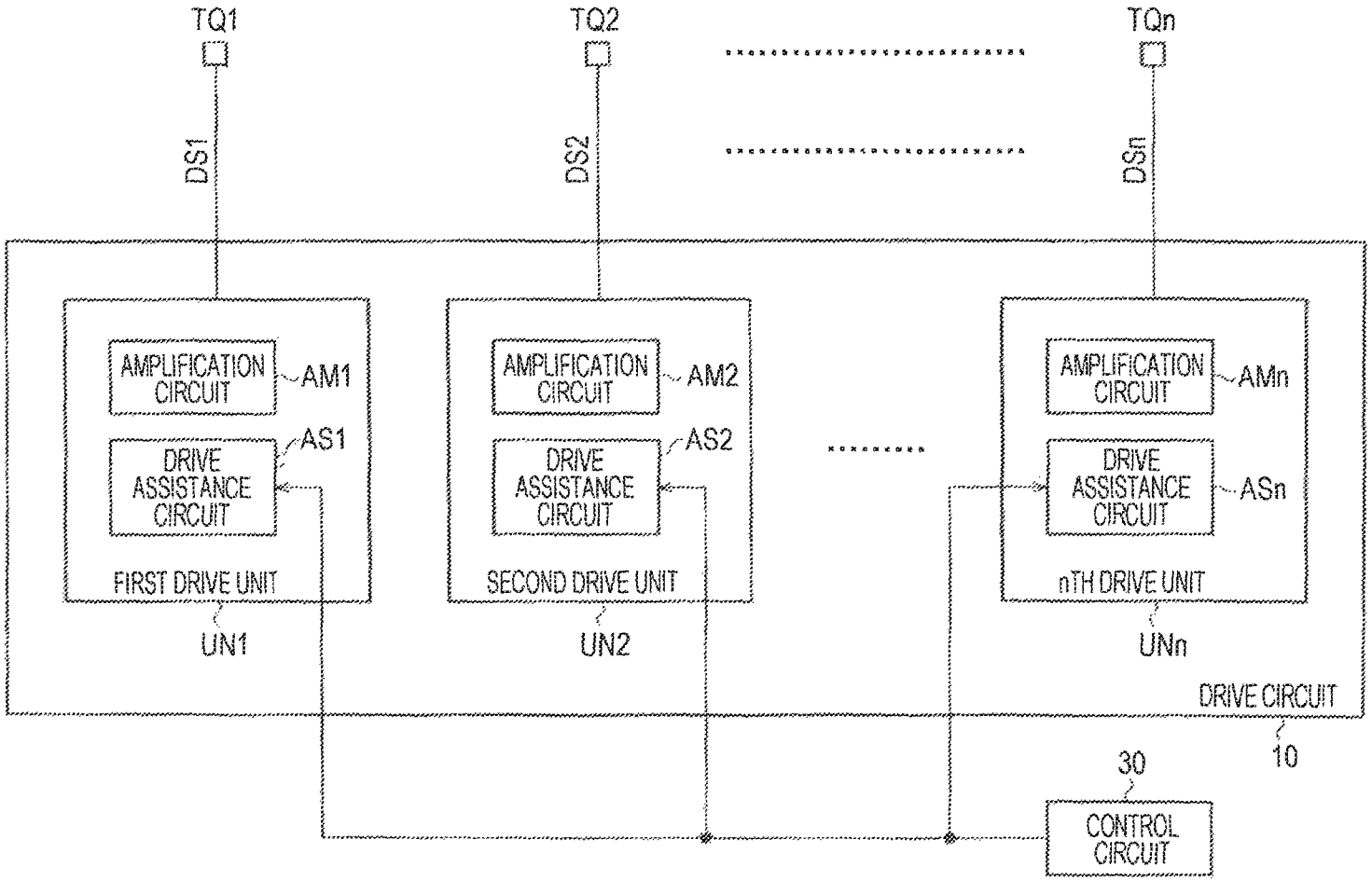
FIG. 1 is a configuration example of a display driver according to an embodiment.

FIG. 1 illustrates a configuration example of a display driver 100 according to an embodiment. The display driver 100 includes a plurality of output terminals TQ1 to TQn, and a drive circuit 10 that outputs a plurality of data signals DS1 to DSn to the plurality of output terminals TQ1 to TQn. Here, n is an integer of 2 or more.

The display driver 100 is, for example, an integrated circuit device, and the output terminal TQi is a pad (a pad formed on a silicon substrate) of the integrated circuit device or a terminal (a terminal to be mounted on a circuit substrate) of a package. Here, i is an integer larger than or equal to 1 and smaller than or equal to n−1. The adjacent output terminals TQi and TQi+1 are connected to adjacent data lines among a plurality of data lines (a plurality of video lines) of an electro-optical panel. Other output terminals are not provided between the output terminals TQi and TQi+1 on the silicon substrate or on the package. Terminals other than the output terminals may be provided between the output terminals TQi and TQi+1.

The drive circuit 10 includes a plurality of drive units UN1 to UNn, and each drive unit of the plurality of drive units UN1 to UNn includes an amplification circuit AM (AM 1 to AMn) and a drive assistance circuit AS (AS1 to ASn) which assists drive by using the amplification circuit AM. The drive unit UNi is connected to the output terminal TQi.

As will be described below, an operation of the drive unit UNi is divided into a preliminary drive period and an amplification drive period with reference to FIG. 8. In the preliminary drive period, the drive assistance circuit ASi performs preliminary drive based on gradation change information and brings a data voltage (data signal DSi) close to a target voltage (voltage corresponding to the display data) in a short time. During the subsequent amplification drive period, the data voltage is corrected to become the target voltage with higher accuracy by feedback control of the amplification circuit AMi. A configuration example of the drive assistance circuit ASi and an operation example of the drive unit UNi will be described below in detail.

In the drive circuit 10 which performs such a digital assistance drive, it is important that an error between the data voltage arriving at the preliminary drive and the target voltage is small. If the error is small, the drive capability of the amplification circuit AMi is not required, and thus, accuracy increases, and current consumption and heat generation can be suppressed.

It is assumed that a gradation of the display data which becomes an output target in a given drive unit UNi is changed from 64 to 128. In this case, the target voltage in the drive unit UNi changes from a voltage corresponding to a gradation 64 to a voltage corresponding to a gradation 128, and a voltage difference is a voltage corresponding to a gradation change of +64.

It is considered that, if the target voltage corresponding to the gradation 64 is output with high accuracy during the amplification drive period, the drive assistance circuit ASi in the next preliminary drive period may perform drive assistance by drive assistance capability for realizing a voltage change corresponding to a gradation change of +64 toward the gradation 128. That is, in short, it is considered that each drive unit of the plurality of drive units UN1 to UNn may determine the drive assistance capability based on its own gradation change information without considering a state of the other drive units.

Figure 2:
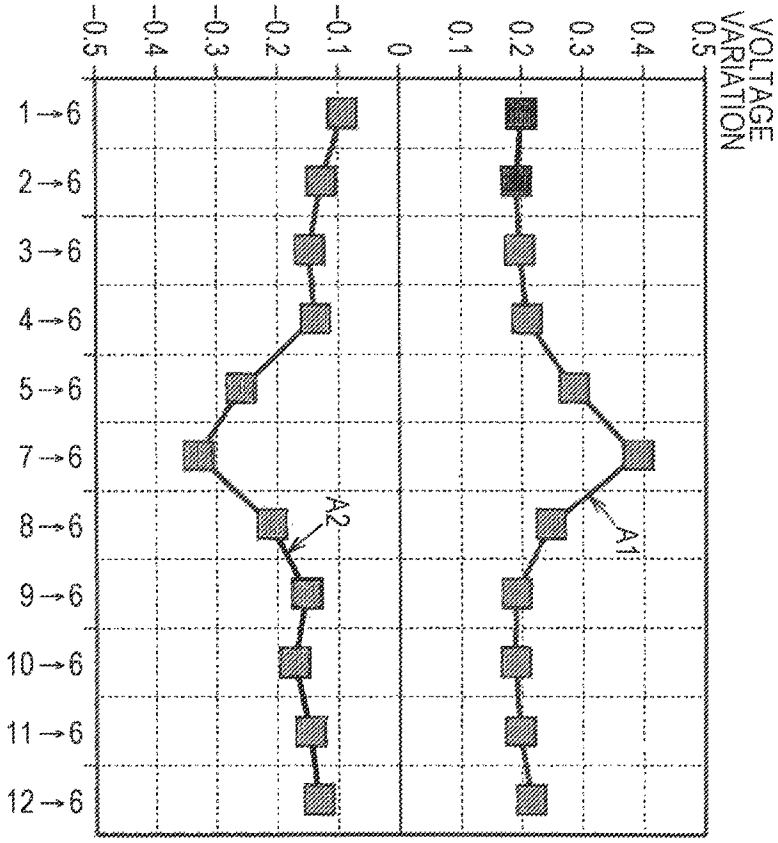
FIG. 2 is an example of voltage variation due to coupling of parasitic capacitances between data lines.

However, it is found that proper control cannot be realized without considering the gradation changes of other drive units. FIG. 2 illustrates a diagram showing how the data voltage (a voltage of the output terminal TQ6) of the sixth drive unit UN6 varies depending on variation of data voltage (voltages of the other output terminals TQ1 to TQ5 and TQ7 to TQ12) of the other drive units, in a case where n=12. The display driver 100 is connected to, for example, an electro-optical panel 200 of FIG. 3 which will be described below, and the output terminal TQ6 has a high impedance (a state where the output terminal Q6 is not driven by an amplifier or the like). j→6 (j is an integer from 1 to 5 and from 7 to 12) in FIG. 2 represents the variation of the data voltage of the sixth drive unit UN6 in a case where the data voltage of the jth drive unit UNj changes. In addition, this corresponds to a case where A1 changes the data voltage of another drive unit by +5.0 V, and corresponds to a case where A2 changes the data voltage of another drive unit by −5.0 V. In the example of FIG. 2, for example, in a case where the data voltage of the first drive unit UN1 changes by +5.0 V, the data voltage of the sixth drive unit UN6 varies by approximately +0.2 V (left end of A1) and in a case where the data voltage of the first drive unit UN1 changes by −5.0 V, the data voltage of the sixth drive unit UN6 varies by about −0.1 V (left end of A2). However, a specific voltage variation depends on a configuration of the electro-optical panel.

As can be seen from FIG. 2, it is found that, in a case where the data voltages of other drive units change in a positive direction (high potential side power supply voltage VDD direction), the data voltage of the sixth drive unit UN6 also tends to change in the positive direction (A1), and in a case where the data voltages of other drive units change in a negative direction (low potential side power supply voltage VSS direction), the data voltage of the sixth drive unit UN6 also tends to change in the negative direction (A2).

A variation width of the voltage is large at 5→6 and 7→6, and it is not preferable to ignore influence of data voltage variation of adjacent drive units (here, the fifth and seventh drive units UN5 and UN7). That is, the data voltage of the sixth drive unit UN6 during the preliminary drive period is determined by an output of the drive assistance circuit AS6 of the UN6 itself and the fluctuation due to the voltage variation of an adjacent drive unit. Hence, in a case where the drive assistance capability is set such that the data voltage reaches the target voltage by an output of the drive assistance circuit AS6, an error corresponding to influence of the voltage variations of the adjacent drive units occurs between the data voltage and the target voltage. The error needs to be corrected in calculating the drive assistance capability of the drive assistance circuit AS6.

In addition, as can be seen from j→6 (j=1 to 4 and 8 to 12) in FIG. 2, the data voltage varies even at the data voltage variation of the drive units other than the adjacent drive units. Furthermore, if the data voltage variation simultaneously occurs in the first drive unit UN1 and the second drive unit UN2, the data voltage of the sixth drive unit UN6 varies by a voltage corresponding to a total sum of the variation of 1→6 and the variation of 2→6. If the variation directions of the data voltages of other drive units are the same, a variation width of the data voltage of the sixth drive unit UN6 is larger, and if the variation directions are different from each other, the variation width of the data voltage of the sixth drive unit UN6 is negligibly small. That is, the data voltage variation of the sixth drive unit UN6, that is, an error from the target voltage is determined in accordance with a variation tendency of overall data voltages of other drive units. The error also needs to be corrected in calculating the drive assistance capability.

The variation illustrated in FIG. 2 is considered to be caused by parasitic capacitances between data lines which will be described below with reference to FIG. 4. Here, the parasitic capacitances include parasitic capacitances (hereinafter, also referred to as adjacent capacitances) between adjacent data lines and all parasitic capacitances (hereinafter, also referred to as common capacitances) between data lines which are not adjacent are also considered. An error due to the data voltage variation of the adjacent drive units described above occurs in coupling of the adjacent capacitances. In addition, errors due to the data voltage variations of the all drive units occur in coupling of the common capacitances.

In this regard, in the present embodiment, the drive assistance capability of the drive assistance circuit ASi of the ith drive unit UNi among the plurality of drive units UN1 to UNn changes, based on gradation change information of the drive units other than the ith drive unit UNi.

Here, the gradation change information is information representing a change of a gradation (a gradation value). Specifically, the gradation change information may be a difference value between a gradation of the display data at a given timing and a gradation of the display data at a timing prior to the gradation, or may be other information corresponding to the difference value. In addition, the display driver 100 according to the present embodiment includes the plurality of drive units UN1 to UNn, and the gradation change information can be obtained for each drive unit. In a case where a liquid crystal display panel of a phase development type is used, a gradation change of the display data between simultaneous writing of n pixels at a given timing and simultaneous writing of the n pixels at a next timing may be referred to as the gradation change information. Specifically, the gradation change information for each of the n drive units is obtained by the gradation change in the pth drive and the (p+1)th drive of phase development. p is an integer of 1 or more, and an upper limit value of p is determined by the number of source lines of the electro-optical panel and n.

According to a method of the present embodiment, the drive assistance circuit ASi operates in accordance with the drive assistance capability in which influence caused by the parasitic capacitances (adjacent capacitances, common capacitances) between the data lines is considered. Thereby, a data voltage can be changed more accurately into the target voltage even in the drive without feedback control. Accordingly, in a case where the data voltage is settled to the target voltage by the amplification circuit AMi, it is possible to reduce an error to be corrected, and to output an accurate data voltage while reducing power consumption (drive capability) of the amplification circuit AMi.

In addition, the parasitic capacitances between the data lines depend on the product of the electro-optical panel (or individual differences even in the same product). In this regard, in the present embodiment, the drive circuit 10 on the display driver 100 side controls to suppress the influence caused by the capacitances between the data lines. By doing so, it is possible to suppress a decrease in display quality in correspondence with various electro-optical panels, and there is no need to provide an adjustment mechanism or the like on the electro-optical panel side.

As described with reference to FIG. 3, transistors for sampling data signals in source lines in the electro-optical panel have a source, a drain, a drain, and a source which are arranged in parallel in this sequence. Accordingly, as described with reference to FIGS. 4 to 6, parasitic capacitances (adjacent capacitances) between the data lines are different in each data line and variation of the data voltage due to coupling of the parasitic capacitances fluctuates in each data line. In a case where the voltage variation due to the adjacent capacitances fluctuates as described above, adjacent terminals on one side and adjacent terminals on the other side cannot be handled in the same row. Specifically, if a difference between an adjustment width of drive assistance capability in which adjacent capacitances to one terminal are considered and an adjustment width of drive assistance capability in which adjacent capacitances to the other terminal are considered is not provided, there is a possibility that appropriate control cannot be performed.

In this regard, in the present embodiment, a capacitance circuit CCi may be provided between the adjacent output terminals TQi and TQi+1, and a capacitance value of the capacitance circuit CCi may be controlled. Thereby, it is possible to adjust (correct) the total sum of the parasitic capacitance between the data lines and the capacitance value of the capacitance circuit CCi in the electro-optical panel such that the total sum is approximately the same in each data line. Since the capacitance between the data lines is approximately the same in each data line, variation of the data voltage due to coupling of the capacitances is approximately uniform in each data line, and the drive assistance capability is easily adjusted. In addition, it is also possible to automatically adjust the capacitance value of the capacitance circuit CCi as described with reference to FIGS. 17 to 23.

2. Electro-Optical Panel

Figure 3:
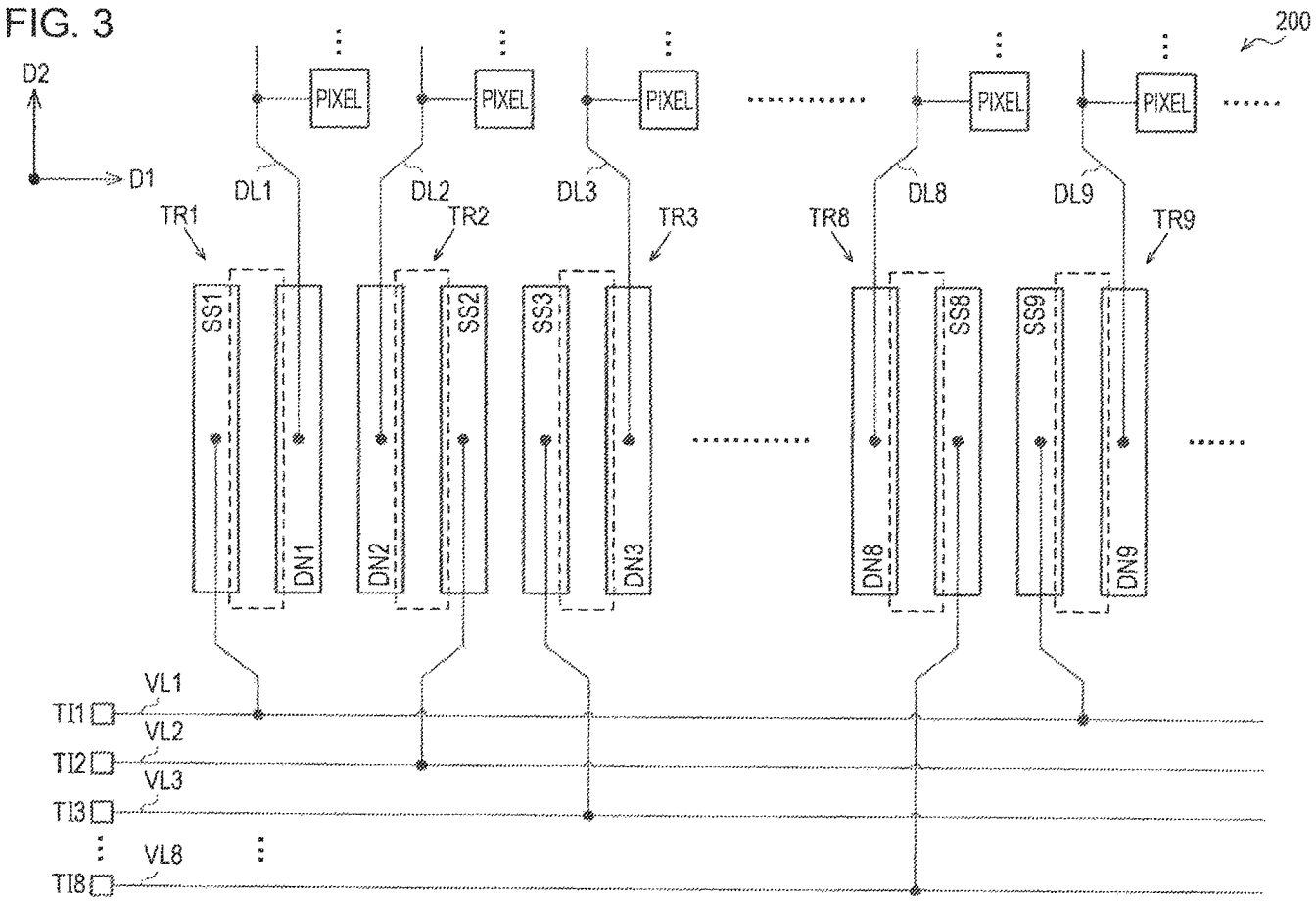
FIG. 3 is a configuration example of an electro-optical panel.

FIG. 3 illustrates a configuration example of the electro-optical panel 200 driven by the display driver 100. In the following description, a liquid crystal display panel of a phase development type of an active matrix type will be described as an example, and an application target of the display driver 100 according to the present embodiment is not limited to this. That is, the display driver 100 according to the present embodiment can be applied an electro-optical panel as long as the electro-optical panel is a type and a drive type in which there is a possibility that display unevenness is formed due to fluctuation of a parasitic capacitance between the data lines. In addition, the electro-optical panel is not limited to the liquid crystal display panel, and may be a display panel (for example, an organic EL display panel) which uses, for example, self-light emitting elements.

The electro-optical panel 200 includes a sample and hold circuit that samples and holds a plurality of video signals, which are a plurality of data signals DS1 to DS8. The plurality of output terminals TQ1 to TQ8 of the display driver 100 are connectable to one terminal of the sample and hold circuit. In the following description, a case where n=8 will be described as an example, and n is not limited to 8.

Specifically, the sample and hold circuit includes transistors TR1, TR2, TR3, . . . respectively connected to the source lines DL1, DL2, DL3, . . . . If the transistors TR1, TR2, TR3, . . . are turned on, the video signals are sampled to the source lines DL1, DL2, DL3, . . . , and if the transistors are turned off, the video signals are held in the source lines DL1, DL2, DL3, . . . . Here, the video signals are drive signals which are used to drive the electro-optical panel by the display driver during the phase development drive.

In a case where the sample and hold circuit is provided, if there is an error between the voltage and a target voltage (a voltage corresponding to the display data) at a timing of holding the voltage on the source line, the error causes display unevenness. One cause of the error is the parasitic capacitance between the data lines (video lines). In this regard, in the present embodiment, the drive assistance capability is adjusted or the capacitances between the data lines are adjusted by the capacitance circuits CC1 to CC8 are performed, and thus, it is possible to reduce the display unevenness.

In addition, in the present embodiment, the electro-optical panel 200 includes a plurality of input terminals TI1 to TI8 connected to a plurality of output terminals TQ1 to TQ8 of the display driver 100. Each transistor of the plurality of transistors TR1, TR2, TR3, . . . has a drain connected to a pixel and a source connected to one input terminal of the plurality of input terminals TI1 to TI8. The first transistor TR1 has the source and the drain arranged in this sequence in a first direction D1 of the electro-optical panel 200. The second transistor TR2 adjacent to the first transistor TR1 has the drain and the source arranged in this sequence in the first direction D1. In FIG. 3, gates of the transistors are denoted by dotted lines of a rectangular type.

Specifically, the data lines VL1 to VL8 (video lines) arranged in the first direction D1 are connected to the input terminals TI1 to TI8. The data lines VL1 to VL8 are connected to the sources SS1 to SS8 of the transistors TR1 to TR8, and the data lines VL1 to VL8 are connected to sources of next eight transistors in the same manner. The drains DN1, DN2, DN3, . . . of the transistors TR1, TR2, TR3, . . . are connected to the source lines DL1, DL2, DL3, . . . , and the respective source lines are connected to a plurality of pixels (liquid crystal cells, pixel circuits). The respective transistors are arranged such that a longitudinal direction (direction of a channel width) thereof becomes a second direction D2 orthogonal (intersecting) to the first direction D1.

As such, the transistors are arranged such that sequences of the sources and the drains thereof alternate (source, drain, drain, source) with each other, and thereby, the data lines and the source lines are arranged so as to be the data line, the source line, the source line, and the data line. By doing so, a case where two source lines are located between two data lines and a case where two data lines are adjacent to each other are provided. Accordingly, a difference between the parasitic capacitances is made between the data lines.

In addition, both the data line and the source line are arranged in the same region in the arrangement portion of the transistors. In order to densely arrange the pixels and the source lines, the transistors and wires thereof also need to be arranged as densely as possible, and thus, a distance between the lines is significantly narrowed in the portion where both the data line and the source line are arranged. Accordingly, the parasitic capacitance between the data lines in the arrangement portion of the transistors occupies a large proportion of the parasitic capacitance between the data lines in all the data lines, and the difference between the parasitic capacitances between the data lines influences as described above.

Figure 4:
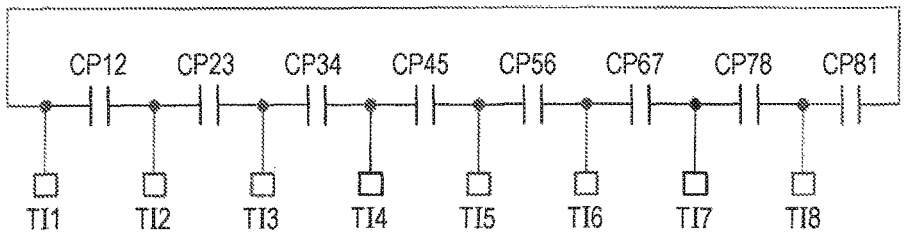
FIG. 4 is a diagram schematically illustrating the parasitic capacitances between the data lines.

FIG. 4 is a diagram schematically illustrating parasitic capacitances between the data lines. The capacitances CP12, CP23, CP34, CP45, CP56, CP67, CP78, and CP81 indicate parasitic capacitances between adjacent input terminals (adjacent output terminals of the display driver 100) of the electro-optical panel 200. For example, the capacitance CP12 is the parasitic capacitance between the input terminals TI1 and TI2.

In addition, while not illustrated in FIG. 4, the parasitic capacitances also exist between terminals other than adjacent input terminals. For example, parasitic capacitances CM24, CM25, CM26, CM27, and CM28 may be respectively considered between the input terminal TI2 and the input terminals TI4 to T18. Hereinafter, the parasitic capacitances between the input terminal TI2 and the input terminals other than the input terminal TI2 are collectively referred to as a common capacitance CM2. The same applies to the other input terminals, and the adjacent capacitances (CP12 and CP23 in a case of TI2) and the common capacitance (CM2 in a case of TI2) may be considered as the parasitic capacitances of the respective input terminals.

Figure 5:
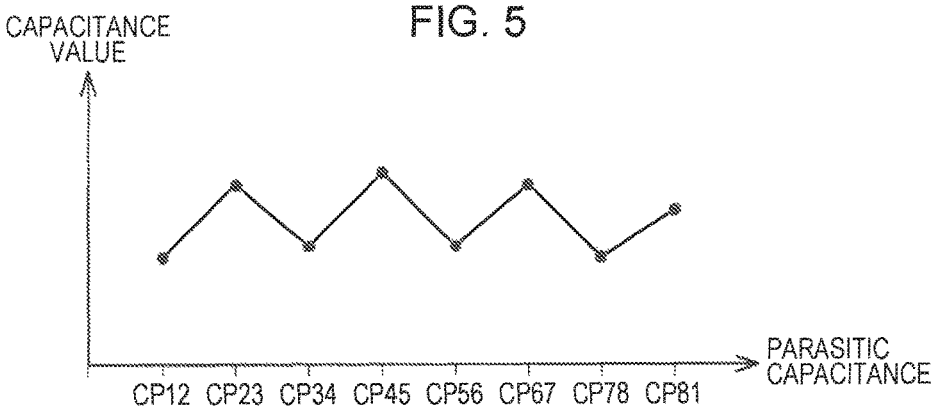
FIG. 5 is a diagram schematically illustrating capacitance values of the parasitic capacitances between adjacent data lines.

FIG. 5 is a diagram schematically illustrating capacitance values of the parasitic capacitances between adjacent data lines. As described with reference to FIG. 3, the parasitic capacitance between adjacent data lines fluctuates depending on arrangement of transistors which are the sample and hold circuit. In FIG. 3, the drains DN1 and DN2 are arranged between the sources SS1 and SS2 of the transistors TR1 and TR2, and thereby, the drains DN1 and DN2 (source lines DL1 and DL2) are arranged between the data lines VL1 and VL2. Meanwhile, the sources SS2 and SS3 of the transistors TR2 and TR3 are arranged to be adjacent to each other, and thereby, the data lines VL2 and VL3 are arranged to be adjacent to each other. From this, a capacitance value of the parasitic capacitance CP12 is smaller than a capacitance value of the parasitic capacitance CP23 as illustrated in FIG. 5. In the same manner, capacitance values of the parasitic capacitances CP34, CP56, and CP78 are relatively smaller than capacitance values of the parasitic capacitances CP45, CP67 and CP81. FIG. 5 is an example of characteristics of the parasitic capacitances, and various characteristics can be obtained according to a design of the electro-optical panel.

Figure 6:
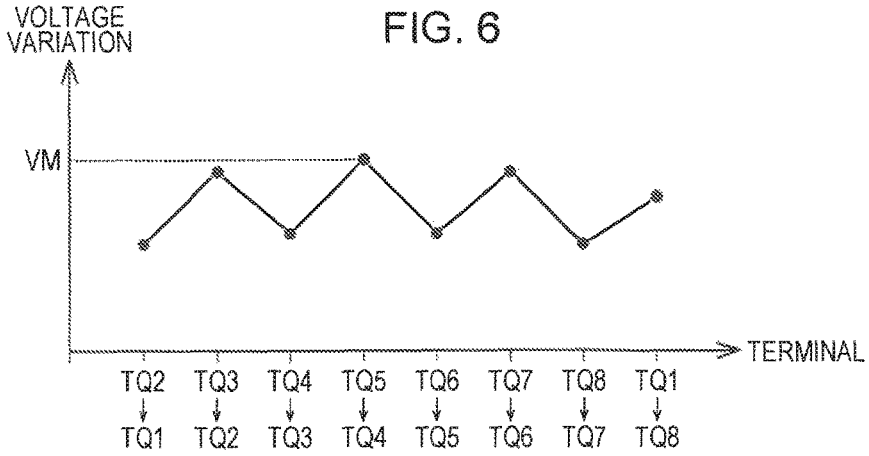
FIG. 6 is an example of the voltage variation due to the coupling of the parasitic capacitances between the adjacent data lines.

FIG. 6 illustrates an example of voltage variation due to coupling of parasitic capacitances between adjacent data lines. FIG. 6 represents the voltage variation of output terminals with high impedance in a case where voltages of the output terminals adjacent to the output terminal with high impedance (in a state where the terminal is not driven by an amplifier or the like) change. For example, "TQ2→TQ1" illustrates the voltage variation of the output terminal TQ1 with high impedance in a case where a voltage of the output terminal TQ2 changes (for example, changes from the lowest gradation to the highest gradation). While not illustrated, the voltage variation of "TQ1→TQ2" is the same as the voltage variation of "TQ2→TQ1".

The greater the parasitic capacitance between the data lines is, the greater the voltage variation due to coupling of the parasitic capacitances. That is, characteristic of the voltage variation are the same as characteristics of the parasitic capacitance of FIG. 5. For example, if the parasitic capacitance between the input terminals TI4 and TI5 (output terminals TQ4 and TQ5) is maximum, the voltage variation of "TQ5→TQ4" is maximized. It is assumed that a maximum value of the voltage variation (voltage difference) is referred to as VM. In the present embodiment, the capacitances between the data lines are adjusted such that the voltage variation between the adjacent output terminals is the same (includes approximately the same as) as the maximum value VM, that is, such that the capacitance between the data lines is the same as a maximum capacitance value. For example, a capacitance value of the capacitance circuit CC3 is adjusted such that the total sum of capacitance values of the capacitance circuit CC3 and the parasitic capacitance CP34 is the same as a capacitance value of the parasitic capacitance CP45. By doing so, fluctuation of the capacitance value of the parasitic capacitance can be suppressed, and thus, calculation processing of the drive assistance capability becomes easy.

3. Drive Circuit

The drive circuit 10 will be described in detail. First, a configuration example and an operation example of the drive circuit 10 will be described with reference to FIGS. 7 and 8, and thereafter, a calculation method of the drive assistance capability will be described in detail with reference to FIGS. 9 to 14.

3.1 Configuration Example and Basic Operation Example of Drive Circuit

Figure 7:
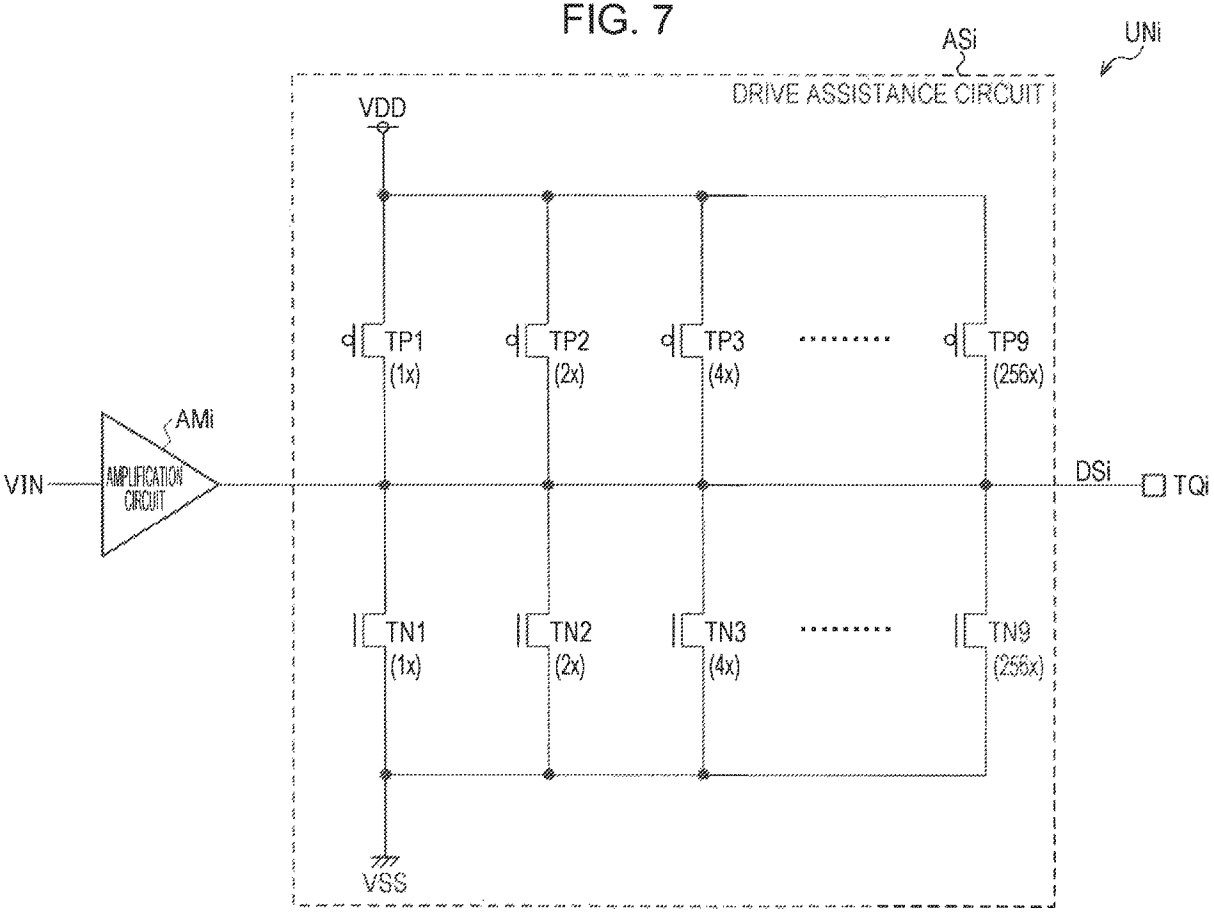
FIG. 7 is a detailed configuration example of a drive circuit.

FIG. 7 is a detailed configuration example of the drive circuit 10. The drive circuit 10 (drive unit UNi) in FIG. 7 includes an amplification circuit AMi provided corresponding to the output terminal TQi and a drive assistance circuit ASi which assists drive performed by the amplification circuit AMi. The drive assistance circuit ASi performs a preliminary drive before the amplification circuit AMi drives. The preliminary drive is performed based on gradation change information of the data signal DSi. In the following description, the amplification circuit AMi and the drive assistance circuit ASi in the drive unit UNi provided corresponding to a given output terminal TQi will be described as an example, and other drive units may have the same configurations.

In a case where a gradation change direction is a high potential power supply direction, the drive assistance circuit ASi performs assistance such that an output (data voltage, data signal) of the drive circuit 10 is changed to the high potential power supply direction, and in a case where the gradation change direction is a low potential power supply direction, the drive assistance circuit ASi performs assistance such that the output of the drive circuit 10 is changed to the low potential power supply direction. Here, an example in which a voltage value increases as the gradation increases, that is, an example in which the gradation change direction in the high potential power supply direction is a direction in which the gradation increases is described, but the embodiment is not limited to this.

By doing so, it is possible to change the output of the drive circuit 10 (drive unit UNi) in a direction matching the gradation change direction by using the drive assistance circuit ASi. Since the data voltage arriving at the preliminary drive period approaches a target voltage, it is possible to suppress the drive capability required for the amplification circuit AMi, and the like.

The drive assistance circuit ASi includes a first drive transistor group on the high potential power supply side and a second drive transistor group on the low potential power supply side. In a case where the gradation change direction is the high potential power supply direction, the drive assistance circuit ASi changes drive capability of the first drive transistor group based on the gradation change information, and in a case where the gradation change direction is the low potential power supply direction, the drive assistance circuit ASi changes drive capability of the second drive transistor group based on the gradation change information. By doing so, it is possible to perform drive assistance using the two drive transistor groups.

Specifically, the amplification circuit AMi amplifies an output voltage VIN of a D/A conversion circuit (D/A conversion circuit 40 of FIG. 24) and outputs the amplified voltage to the output terminal TQi. The drive assistance circuit ASi includes P-type transistors TP1 to TP9 (first conduction type transistors) provided between a node of a high potential side power supply voltage VDD and the output terminal TQi, and an N-type transistors TN1 to TN9 (second conduction type transistors) provided between a node of a low potential side power supply voltage VSS and the output terminal TQi. The P-type transistors TP1 to TP9 correspond to the first drive transistor group and the N-type transistors TN1 to TN9 correspond to the second drive transistor group.

In a case where drive capability of the transistors TP1 and TN1 is 1×, drive capability of the transistors TPk and TNk (k is an integer larger than or equal to 1 and smaller than or equal to 9) is $2^{k-1}$×. For example, the drive capability is a drain current with respect to the same gate-source voltage, and is set by, for example, a channel width (W/W of L) of the transistor or the number of unit transistors. The transistors TP1 to TP9 and TN1 to TN9 are turned on or off by a control circuit 30. The control circuit 30 calculates drive assistance capability according to the voltage change (gradation change of display data) of the data signal DSi and turns on the transistor of the drive capability corresponding to the drive assistance capability thereof, and the preliminary drive is performed by the transistor which is turned on. In the example of FIG. 7, the drive capability can be set 1× step by 1× step within a range of 1× to 511×.

Figure 8:
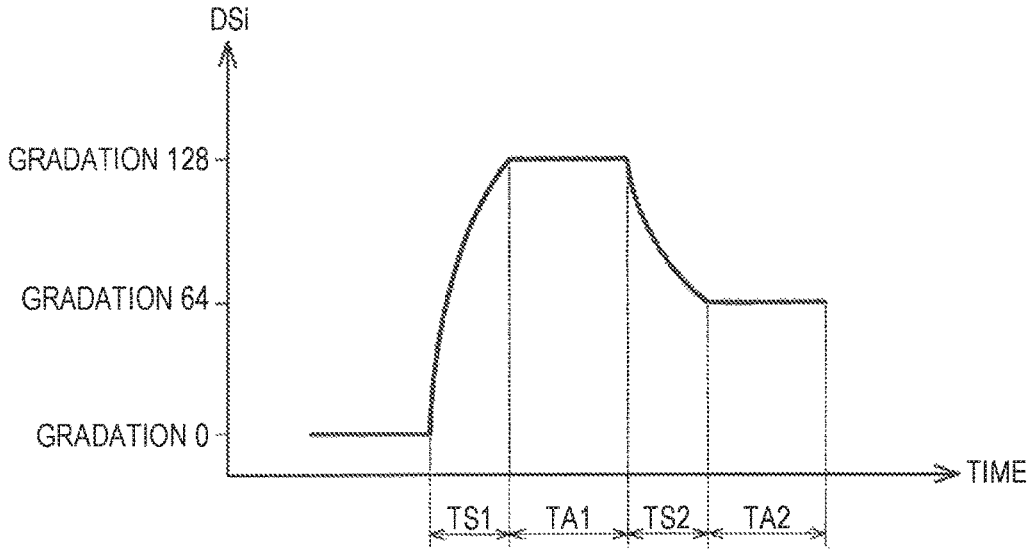
FIG. 8 is a diagram illustrating an operation of the drive circuit.

FIG. 8 is a diagram illustrating an operation of the drive circuit 10 of FIG. 7. In FIG. 8, a case where the gradation is changed from 0 to 128 and a case where the gradation is changed from 128 to 64 will be described as an example. In addition, here, it is assumed that a voltage of the data signal DSi is large as the gradation is large.

In a case where the gradation is changed from 0 to 128, the drive assistance circuit ASi changes the data signal DSi from a voltage corresponding to the gradation 0 to a voltage (that is, high potential side power supply voltage VDD Side) corresponding to the gradation 128, during a preliminary drive period TS1. During an amplification drive period TA1 after the preliminary drive period TS1, the amplification circuit AMi outputs the voltage corresponding to the gradation 128 to the output terminal TQi.

During the preliminary drive, the control circuit 30 calculates the drive assistance capability for generating a voltage difference corresponding to the gradation difference during the preliminary drive period TS1 from a difference (128−0=128) between a gradation of the display data in the previous drive and the gradation of a current drive. For example, the larger the gradation difference is, the larger drive assistance capability is set. In addition, the control circuit 30 calculates drive assistance capability according to a target voltage (voltage corresponding to the gradation 128). For example, in a case where a voltage change of the data signal DSi is positive, the more the target voltage is close to the high potential side power supply voltage VDD (the more the gradation is close to a maximum gradation), the larger drive capability is set. In a case where the voltage change of the data signal DSi is positive, the control circuit 30 turns on or off the P-type transistors TP1 to TP9 of the drive assistance circuit ASi such that the transistors have the calculated drive assistance capability. The N-type transistors TN1 to TN9 are turned off.

However, in the present embodiment, the drive assistance capability is calculated in consideration of the voltage variation (gradation change) of other drive units, without simply setting the drive assistance capability for realizing a voltage difference corresponding to a gradation difference 128. Detailed calculation processing will be described below with reference to FIGS. 9 to 14.

In a case where the gradation is changed from 128 to 64, the drive assistance circuit AS1 changes the data signal DS1 from a voltage corresponding to the gradation 128 to a voltage (that is, the low potential side power supply voltage VSS Side) corresponding to the gradation 64, during the preliminary drive period TS2. During an amplification drive period TA2 after the preliminary drive period TS2, the amplification circuit AMi outputs the voltage corresponding to the gradation 64 to the output terminal TQi.

In this case, since the gradation difference is smaller (128−64=64) than the gradation difference during the preliminary drive period TS1, the capability is reduced in terms of the drive assistance capability according to the gradation difference. In addition, since the voltage change of the data signal DSi is negative, the more the target voltage is close to the low potential side power supply voltage VSS (the more the gradation is close to a minimum gradation), the larger drive assistance capability is set. In a case where the voltage change of the data signal DSi is negative, the control circuit 30 turns on or off the N-type transistors TN1 to TN9 of the drive assistance circuit ASi such that the transistors have the calculated drive assistance capability. The P-type transistors TP1 to TP9 are turned off. In this case, the drive assistance capability may also be calculated by processing which will be described below.

3.2 Calculation Processing of Drive Assistance Capability

As illustrated in FIG. 1, the display driver 100 may include the control circuit 30. The control circuit 30 performs the calculation processing based on the gradation change information to set the drive assistance capability of the drive assistance circuit ASi. That is, the calculation processing which will be described below may be performed by the control circuit 30. Here, it is assumed that the control circuit 30 is the same circuit as a control circuit (the control circuit 30 of FIG. 15) which controls the capacitance circuit CCi, and the control circuit 30 may be a circuit other than the circuit. For example, the control circuit 30 (calculation circuit) corrects the gradation change information of a given drive unit based on the gradation change information of other drive units, and may set the drive assistance capability of the drive assistance circuit corresponding to a given drive unit, based on the corrected gradation change information.

Figure 9:
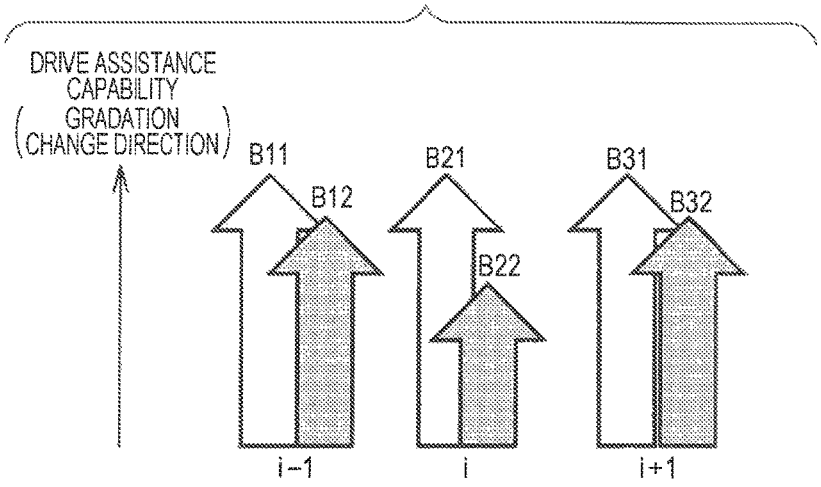
FIG. 9 is a diagram illustrating calculation processing (adjacency calculation) of drive assistance capability.
Figure 10:
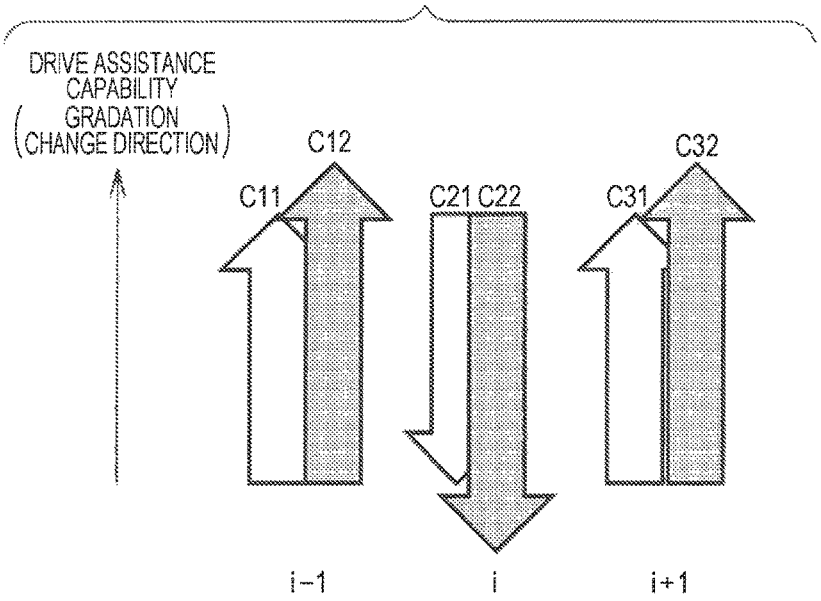
FIG. 10 is a diagram illustrating calculation processing (adjacency calculation) of drive assistance capability.
Figure 11:
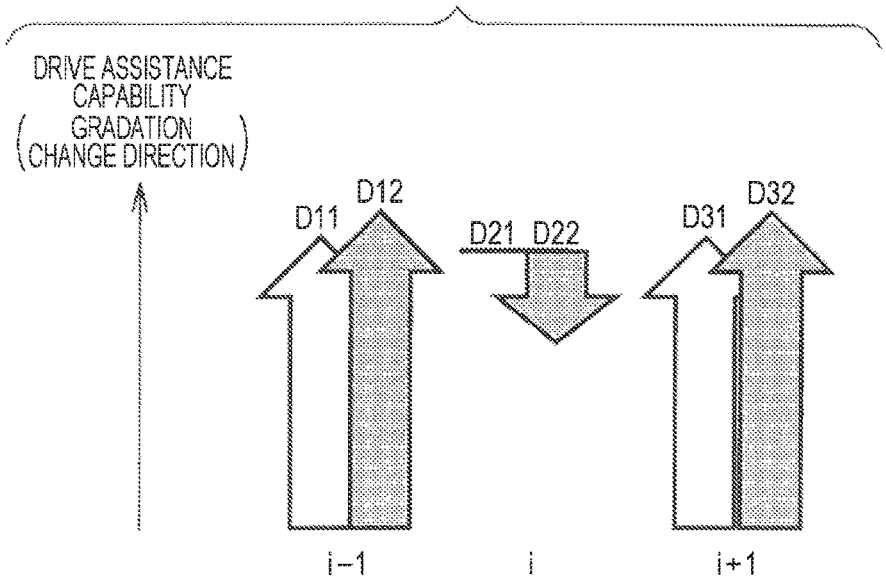
FIG. 11 is a diagram illustrating calculation processing (adjacency calculation) of drive assistance capability.

FIGS. 9 to 11 are diagrams illustrating the calculation processing (adjacency calculation) of the drive assistance capability in a case where the adjacent capacitances are considered. B11, B21, and B31 of FIG. 9 respectively represent gradation changes (or drive assistance capability corresponding to the gradation change) of (i−1)th to (i+1)th drive units UNi−1 to UNi+1. As illustrated in B11 and B21, a gradation change direction of the ith drive unit UNi is the same as a gradation change direction of the (i−1)th drive unit UNi−1 adjacent thereto, in the example of FIG. 9. In this case, the data voltage (data signal DSi) of the ith drive unit UNi varies in a positive direction due to the voltage variation of the (i−1)th drive unit UNi−1. Accordingly, if the drive assistance circuit ASi operates with the drive assistance capability corresponding to B21, the data voltage during the preliminary drive period exceeds the target voltage in a positive direction side.

Hence, in a case where the gradation change direction of the drive unit adjacent to the ith drive unit UNi is the same as the gradation change direction of the ith drive unit UNi, the drive assistance circuit ASi of the ith drive unit UNi decreases the drive assistance capability. According to the example of FIG. 9, the drive assistance capability of the drive assistance circuit ASi of the ith drive unit UNi decreases to B22 lower than B21 corresponding to the gradation change. In the example in which the gradation illustrated in TS1 of FIG. 8 changes from 0 to 128, the drive assistance capability is set to correspond to a gradation change smaller than an actual gradation change+128. By doing so, the data voltage during the preliminary drive period approaches the target voltage by a combination of the drive assistance according to the drive assistance capability of B22 and the data voltage variation caused by the voltage variation of the (i−1)th drive unit UNi−1. The amount of adjustment (set value) of the drive assistance capability may be obtained by, for example, integration of a gradation change width of an adjacent drive unit and adjacent capacitance, or calculation similar thereto. A capacitance value of the parasitic capacitance can be measured by, for example, a method which will be described with reference to FIGS. 17 to 23. In addition, in a case where fluctuation between adjacent capacitances is reduced by the capacitance circuit CCi, a magnitude of the adjacent capacitance can be treated as a common constant by all the drive units, and the calculation processing can be easily performed.

In the example of FIG. 9, the gradation change direction of the ith drive unit UNi is also the same as the gradation change direction of the adjacent (i+1)th drive unit UNi+1 as illustrated in B21 and B31. Hence, the drive assistance capability of the drive assistance circuit ASi of the ith drive unit UNi is further reduced in consideration of the voltage variation due to the voltage variation of the (i+1)th drive unit UNi+1. FIG. 9 illustrates an example in which the gradation change directions coincide in the positive direction, and a point in which the drive assistance capability decreases (voltage variation toward the VSS side is reduced) is the same, even in a case where the gradation changes coincide in the negative direction.

In addition, in a case where the (i−1)th drive unit UNi−1 or the (i+1)th drive unit UNi+1 is focused, the gradation change direction of the drive unit is the same as the gradation change direction of the adjacent ith drive unit UNi. Accordingly, as illustrated in B12 and B32, the (i−1)th drive unit UNi−1 and the (i+1)th drive unit UNi+1 may also have the drive assistance capability decreased more than the capability corresponding to an original gradation change. The drive assistance capability of the (i−1)th drive unit UNi−1 and the (i+1)th drive unit UNi+1 is also calculated by adding influence of the adjacent drive unit on a side opposite to the ith drive unit UNi.

In addition, as illustrated in C11 and C21, the gradation change direction (negative direction) of the ith drive unit UNi is different from the gradation change direction (positive direction) of the (i−1)th drive unit UNi−1 Positive direction), in the example of FIG. 10. In this case, the data voltage of the ith drive unit UNi varies in the positive direction due to the voltage variation of the (i−1)th drive unit UNi−1. Accordingly, if the drive assistance circuit ASi operates with the drive assistance capability corresponding to C21, the data voltage during the preliminary drive period becomes a value on the positive direction side (VDD side) rather than the target voltage, and does not decrease to the target voltage.

Hence, in a case where the gradation change direction of the drive unit adjacent to the ith drive unit UNi is different from the gradation change direction of the ith drive unit UNi, the drive assistance circuit ASi of the ith drive unit UNi increases the drive assistance capability. In the example of FIG. 10, the drive assistance capability of the drive assistance circuit ASi of the ith drive unit UNi increases to C22 higher (a voltage variation width which is realized is large) than C21 corresponding to the gradation change. By doing so, a voltage realized by the drive assistance capability of C22 exceeds the target voltage, but the data voltage variation in a reverse direction due to the voltage variation of the (i−1)th drive unit UNi−1 is cancelled, and the data voltage during the preliminary drive period approaches the target value.

A point in which calculation of the drive assistance capability performed by the (i+1)th drive unit UNi+1 is also required, and a point in which the drive assistance capabilities of the (i−1)th and the (i+1)th drive units UNi−1 and UNi+1 are also adjusted to be C11→C12 and C31→C32 are the same as in FIG. 9.

FIGS. 9 and 10 illustrate an example in which the gradation change direction of the ith drive unit UNi is either the positive direction or the negative direction, but there is also a case where the gradation change is zero (gradation is invariable). If the gradation change is zero, the data voltage may maintain a current value, and as illustrated in D21 of FIG. 11, the preliminary drive performed by the drive assistance circuit ASi is not originally required.

However, as illustrated in D11, if there is a change in gradation in a predetermined direction in adjacent drive units, the data voltage of the ith drive unit UNi varies in the same direction as the predetermined direction due to the adjacent capacitance. Hence, the drive assistance circuit ASi of the ith drive unit UNi may operate with drive assistance capability for suppressing (cancelling) the variation of the data voltage.

That is, in a case where the gradation change of the ith drive unit UNi is zero, the drive assistance circuit ASi of the ith drive unit UNi assists drive in accordance with the gradation change direction of the drive unit adjacent to the ith drive unit UNi. In the example of FIG. 11, since the gradation change of the (i−1)th drive unit UNi−1 is in the positive direction, the drive assistance circuit ASi of the ith drive unit UNi changes the data voltage in the negative direction. That is, the drive assistance capability in a direction opposite to the gradation change direction of the adjacent drive unit is increased. In addition, since the gradation change of the (i+1)th drive unit UNi+1 is also in the positive direction in FIG. 11, the drive assistance capability of the drive assistance circuit ASi of the ith drive unit UNi increases in the negative direction side rather than B21 (B22).

FIGS. 9 to 11 illustrate examples in which the gradation change direction of the (i−1)th drive unit UNi−1 coincides with the gradation change direction of the (i+1)th drive unit UNi+1, and the embodiment is not limited to this. For example, the gradation change direction of the ith drive unit UNi may be the same as the gradation change direction of the (i−1)th drive unit UNi−1, and the gradation change direction of the ith drive unit UNi may be a direction opposite to the gradation change direction of the (i+1)th drive unit UNi+1.

In this case, on a side where the gradation change directions are the same, a calculation result that the drive assistance capability increases is obtained in the same manner as in FIG. 9, and on a side where the gradation change directions are opposite, a calculation result that the drive assistance capability decreases is obtained in the same manner as in FIG. 10. The calculation result of the drive assistance capability of the adjacency calculation may be the total sum of a calculation result on the (i−1)th drive unit UNi−1 and a calculation result on the (i+1)th drive unit UNi+1. The same applies to a case where the gradation change of the ith drive unit UNi is zero as illustrated in FIG. 11.

Figure 12:
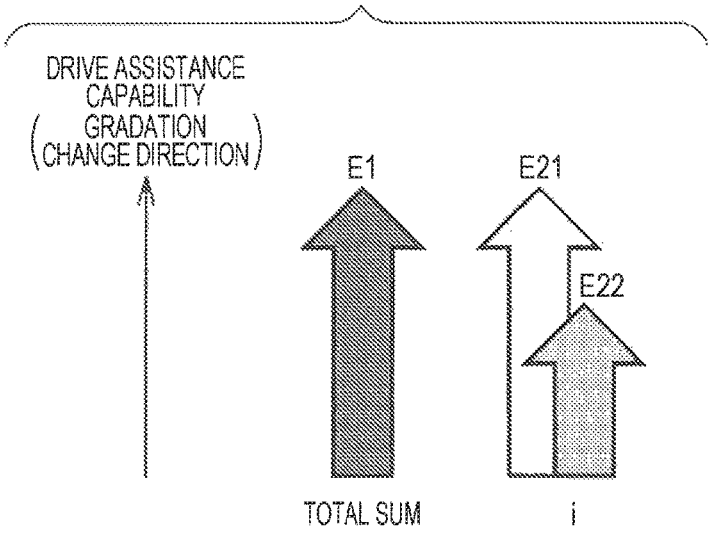
FIG. 12 is a diagram illustrating calculation processing (common calculation) of drive assistance capability.
Figure 13:
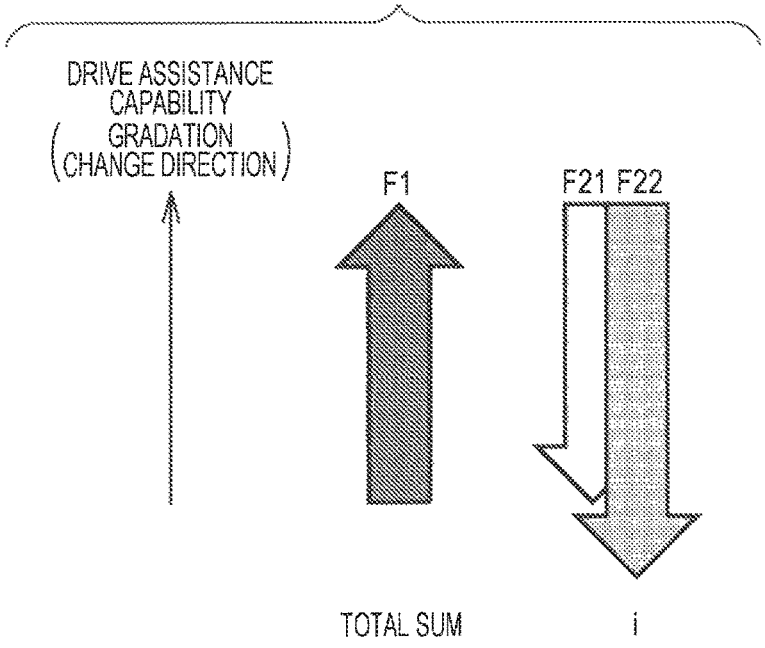
FIG. 13 is a diagram illustrating calculation processing (common calculation) of drive assistance capability.
Figure 14:
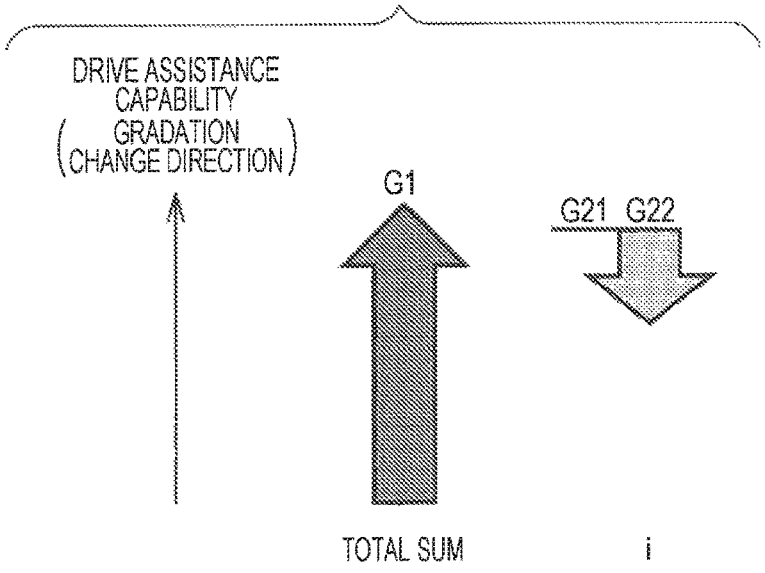
FIG. 14 is a diagram illustrating calculation processing (common calculation) of drive assistance capability.

FIGS. 12 to 14 are diagrams illustrating the calculation processing (common calculation) of the drive assistance capability in a case where the common capacitance is considered. As described above, the data voltage of each data line varies also in the coupling of the common capacitances which are the parasitic capacitances between all the other data lines. Hence, in the present embodiment, tendency (tendency of gradation changes of all the plurality of drive units) of the voltage variation of all the data lines is obtained, and the drive assistance capability of the drive assistance circuit ASi changes based on the obtained information.

Specifically, the drive assistance capability of the drive assistance circuit ASi of the ith drive unit UNi changes on the basis of total sum information of the gradation change information of the plurality of drive units. Here, the total sum information may be the total sum of the gradation changes of the plurality of drive units UN1 to UNn at a given timing, or may be other information corresponding to the total sum. Alternatively, it is also possible to perform a modification such as excluding a part of the gradation change from the total sum of the gradation changes of all the drive units. For example, the gradation change of the drive unit itself which is a calculation target of the drive assistance capability, or the gradation change of the adjacent drive unit may be excluded from the total sum information.

If the gradation change direction represented by the total sum information is the positive direction, the data voltage of each drive unit varies in the positive direction by the common capacitance. In addition, if the gradation change direction represented by the total sum information is the negative direction, the data voltage of each drive unit varies in the negative direction by the common capacitance. Hence, the drive assistance capability of the drive assistance circuit ASi can be calculated by a relationship between the gradation change direction represented by the total sum information and the gradation change direction of the drive unit UNi which is a target.

For example, E1 of FIG. 12 represents the gradation change direction of the total sum information, and E21 represents the gradation change (and drive assistance capability corresponding to the gradation change) of the ith drive unit UNi. In the example of FIG. 12, the gradation change direction of the ith drive unit UNi is the same as the gradation change direction of the total sum information. In this case, the data voltage of the ith drive unit UNi varies in the positive direction due to the voltage variation caused by the common capacitance. Accordingly, if the drive assistance circuit ASi operates with the drive assistance capability corresponding to E21, the data voltage during the preliminary drive period exceeds the target voltage in the positive direction side.

Hence, in a case where the gradation change direction represented by the total sum information of the gradation change information is the same as the gradation change direction of the ith drive unit UNi, the drive assistance capability of the drive assistance circuit ASi of the ith drive unit UNi decreases (E22). By doing so, the data voltage during the preliminary drive period approaches the target value by combining the drive assistance performed by the drive assistance capability of E22 and the data voltage variation caused by the common capacitance. The amount of adjustment (set value) of the drive assistance capability may be obtained by integrating the gradation change width represented by the total sum information and the common capacitance, or calculation similar thereto. In addition, regarding the common capacitance, it is considered that the fluctuation between original output terminals is not large, and if adjustment is performed by the capacitance circuit CCi, the fluctuation can be further reduced. Hence, a magnitude of the common capacitance may be treated as a common constant by all the drive units, and calculation processing can be easily performed.

The same can also be applied to FIGS. 13 and 14 in the same manner as in FIGS. 10 and 11 of adjacency calculation. In a case where the gradation change direction (F1) represented by the total sum information of the gradation change information is different from the gradation change direction (F21) of the ith drive unit UNi, the drive assistance capability of the drive assistance circuit ASi of the ith drive unit UNi increases (F22). In addition, in a case where the gradation change of the ith drive unit UNi is zero (G21), the drive assistance circuit ASi of the ith drive unit UNi assists drive in accordance with the gradation change direction (G1) represented by the total sum information of the gradation change information (G22).

The drive assistance capability such as reducing an error due to capacitive coupling of all the data lines can be calculated by performing the common calculation illustrated in FIGS. 12 to 14, and thereby, it is possible to suppress deterioration of display quality due to the parasitic capacitance.

In the above description, adjacency calculation is described with reference to FIGS. 9 to 11, and common calculation is described with reference to FIGS. 12 to 14. The drive assistance capability of the drive assistance circuit ASi of the ith drive unit UNi is determined based on both adjacency calculation results and common calculation results. Specifically, addition of the adjacency calculation results and the common calculation results may be used as the calculation results of final drive assistance capability.

In a case where a voltage reached by the preliminary drive of the drive assistance circuit ASi deviates from the target voltage (voltage corresponding to the gradation 128 or the gradation 64 in the example of FIG. 8), the drive of the amplification circuit AMi is corrected. However, if there are large correction, a large drive capability is required for the amplification circuit AMi, and power consumption increases. In the preliminary drive of the drive assistance circuit ASi, the parasitic capacitance of the data line and pixel capacitance are charged by a current flowing through the transistor. At this time, if the charged capacitance value changes, the required drive capability also changes. That is, the drive assistance capability required for realizing the same voltage change also varies due to the parasitic capacitance between the data lines. In the present embodiment, the drive assistance capability is calculated based on the voltage variation due to the adjacent capacitance and the common capacitance as described above. Thereby, it is possible to reduce the error between the voltage reached by the preliminary drive and the target voltage, and to reduce power consumption of the amplification circuit AMi. In addition, in the present embodiment, the fluctuation of the capacitance value of the adjacent capacitance described with reference to FIGS. 5 and 6 may be reduced by controlling the capacitance circuit CCi. By doing so, it is unnecessary to differently calculate the drive assistance capability for each data line, and it is possible to simplify the calculation of the drive assistance capability. Detailed control of the capacitance circuit CCi will be described below.

4. Capacitance Circuit

Figure 15:
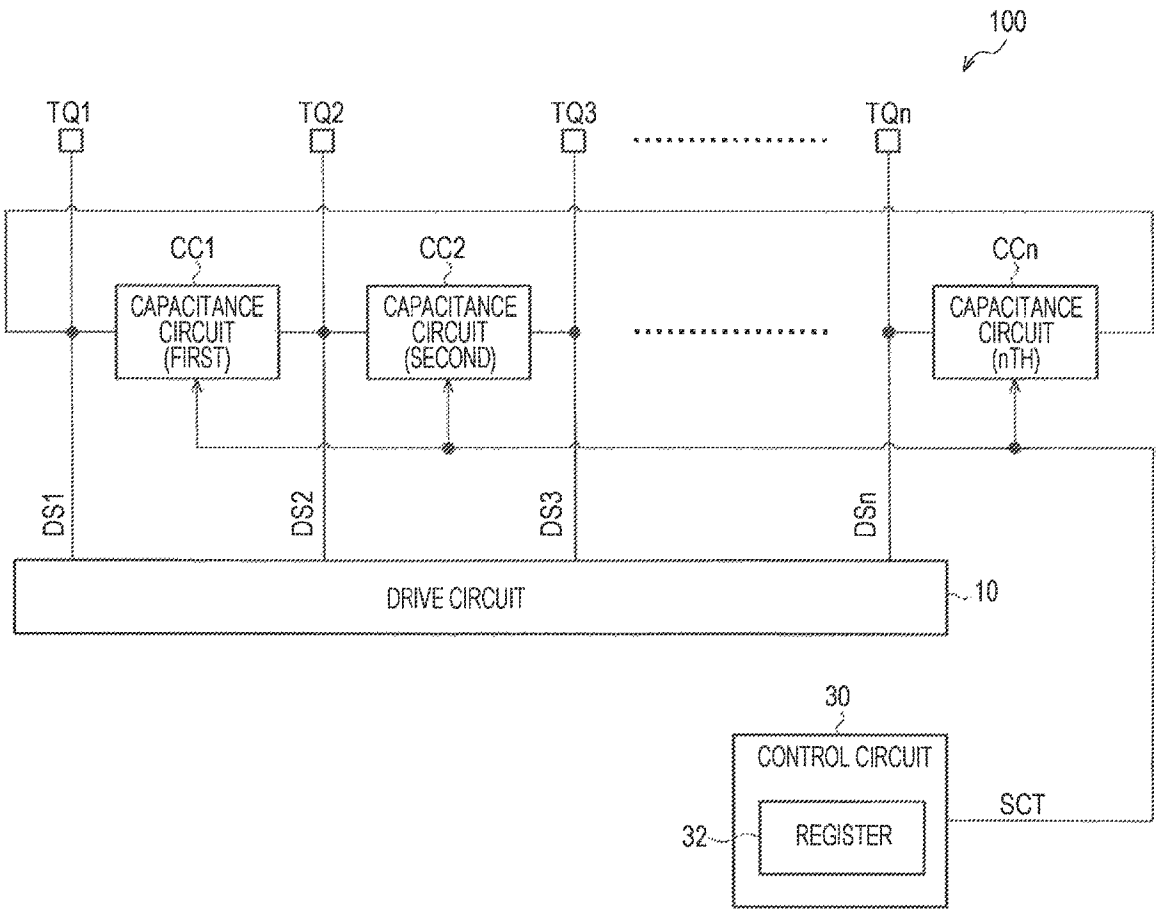
FIG. 15 is another configuration example of a display driver according to the embodiment.

FIG. 15 is a detailed configuration example of the display driver 100 including a plurality of capacitance circuits CC1 to CCn. The display driver 100 includes the plurality of output terminals TQ1 to TQn, the plurality of capacitance circuits CC1 to CCn, and the control circuit 30.

The output terminal TQi and the output terminal TQi+1 are adjacent to each other, one terminal of the capacitance circuit CCi is connected to the output terminal TQi, and the other terminal of the capacitance circuit CCi is connected to the output terminal TQi+1. A capacitance value of the capacitance circuit CCi can be variably adjusted, and the capacitance value is set by a control signal SCT from the control circuit 30. For example, whether or not the capacitance circuit CCi connects each capacitor of the capacitor group is selected by a switch group. In this case, the control signal SCT turns on and off switches.

In the electro-optical panel of a phase development type illustrated in FIG. 2, eight (n) data lines VL1 to VL8 are sequentially connected to every eight transistors. Accordingly, a parasitic capacitance is generated between the eighth data line VL8 and the first data line VL1. For example, an eighth transistor TR8 connected to the eighth data line VL8 is adjacent to a ninth transistor TR9 connected to the first data line VL1. Accordingly, a parasitic capacitance is generated between wires connected to the sources SS8 and SS9 of the transistors. Since the parasitic capacitance exists in every eight transistors, the total sum of those is included in the parasitic capacitance between the eighth data line VL8 and the first data line VL1. The capacitance circuit CCn adjusts (corrects) the capacitance between the nth data line and the first data line.

Figure 16:
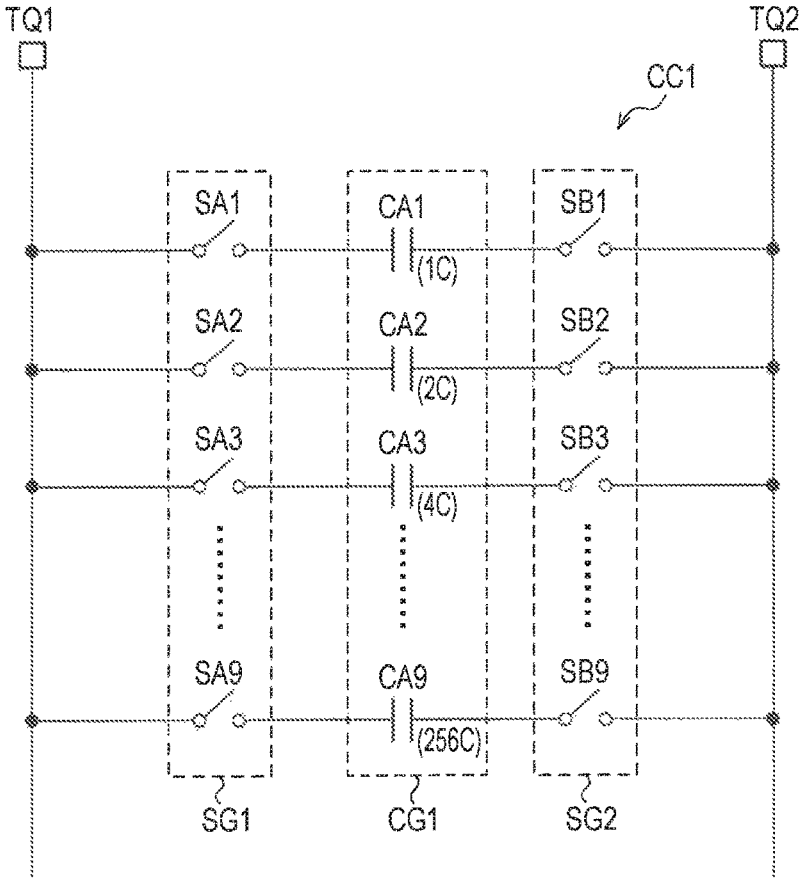
FIG. 16 is a detailed configuration example of a capacitance circuit.

FIG. 16 illustrates a detailed configuration example of the capacitance circuit CC1. The capacitance circuits CC2 to CCn can also be configured to be the same as the capacitance circuit CC1. The capacitance circuit CC1 includes a capacitor group CG1 and at least two switch groups SG1 and SG2 respectively connected between each capacitor of the capacitor group CG1 and the output terminals TQ1 and TQ2.

According to the present embodiment, connections between each capacitor and the output terminals TQ1 and TQ2 can be controlled by the switch groups SG1 and SG2. Thereby, capacitances between the adjacent output terminals TQ1 and TQ2 can be adjusted by the capacitance circuit CC1, and the capacitance between the data lines can be equalized by correcting fluctuation of the parasitic capacitance between the data lines.

Specifically, the capacitance circuit CC1 includes the first switch group SG1 and the second switch group SG2 as at least one switch group. One terminal of the first switch group SG1 is connected to the first output terminal TQ1 (ith output terminal TQi), and the other end thereof is connected to one terminal of the capacitor group CG1. One terminal of the second switch group SG2 is connected to the second output terminal TQ2 ((i+1)th output terminal TQi+1) adjacent to the first output terminal TQ1 and the other terminal thereof is connected to the other terminal of the capacitor group CG1.

More specifically, the switch group SG1 includes switches SA1 to SA9 (in a broad sense, first to pth switches, p is an integer larger than or equal to 2), the capacitor group CG1 includes capacitors CA1 to CA9 (first to pth capacitors), and the switch group SG2 includes switches SB1 to SB9 (first to pth switches). One terminal of the switch SAj (j is an integer larger than or equal to 1 and smaller than or equal to 9) is connected to the output terminal TQ1 and the other terminal thereof is connected to one terminal of the capacitor CAj. One terminal of the switch SBj is connected to the output terminal TQ2, and the other terminal thereof is connected to the other terminal of the capacitor CAj. The switches SAj and SBj are, for example, transistors which are turned on or off by the control circuit 30 illustrated in FIGS. 15 and 24.

According to the present embodiment, the capacitor group CG1 is connected between the adjacent output terminals TQ1 and TQ2 by the first switch group SG1 and the second switch group SG2. Accordingly, each switch can be turned on or off, and thereby, whether or not each capacitor is connected between the adjacent output terminals TQ1 and TQ2 can be controlled. That is, in a case where the switches SAj and SBj are turned on, the capacitor CAj is connected between the output terminals TQ1 and TQ2, and in a case where the switches SAj and SBj are turned off, the capacitor CAj is not connected between the output terminals TQ1 and TQ2.

In the present embodiment, capacitance values of each capacitor of the capacitor group CG1 are weighted by binary numbers. That is, if the capacitance value of the capacitor CA1 is 1C, the capacitance value of the capacitor CAj is $2^{j-1}$C.

By doing so, the capacitance values of the capacitance circuit CC1 can be adjusted by 1C in a range of 1C to 256C ($2^{p-1}$C in a broad sense) by controlling the switch groups SG1 and SG2 with a binary code.

5. Measurement Circuit

Figure 17:
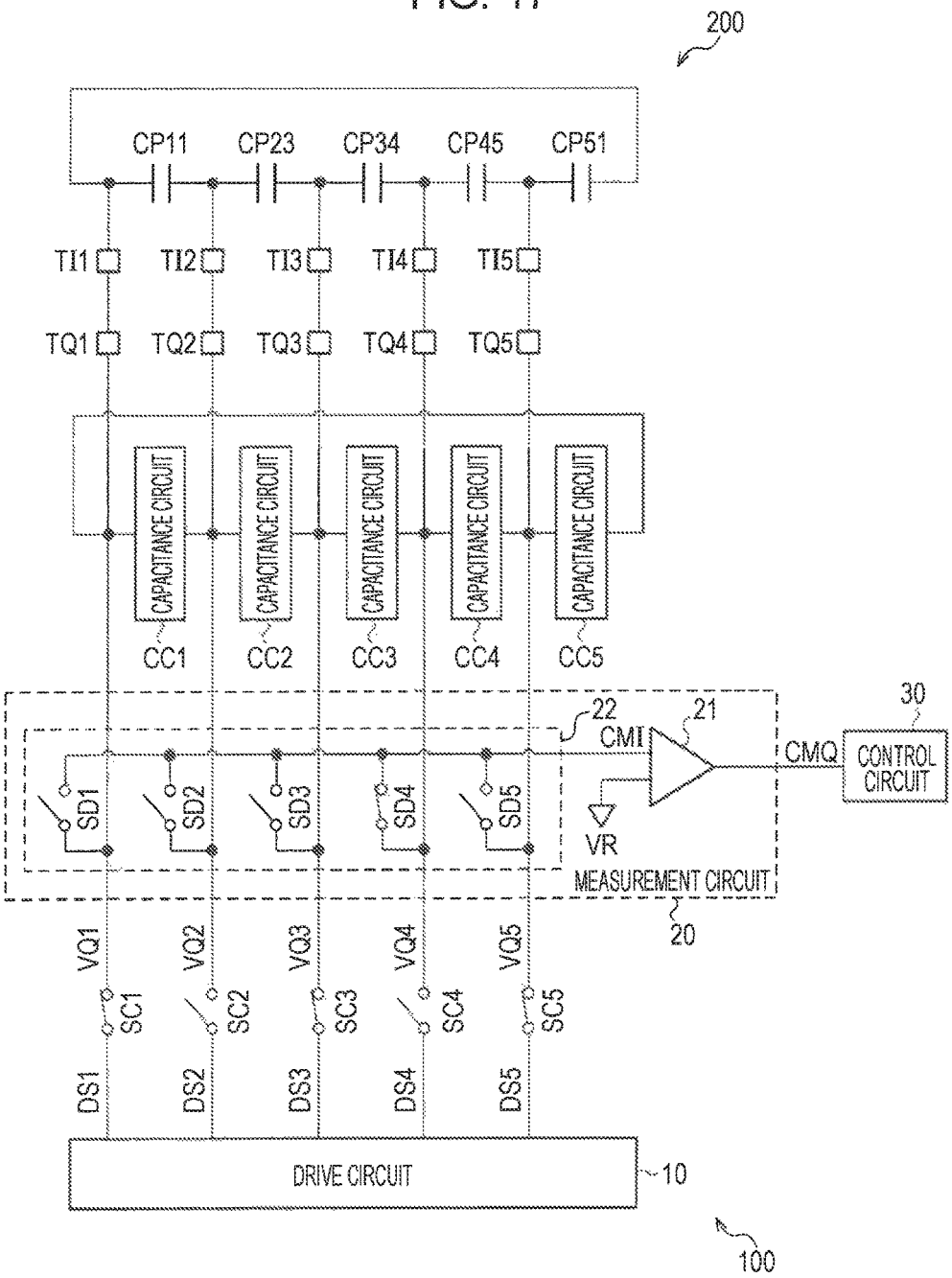
FIG. 17 is a detailed configuration example of the display driver in a case where a measurement circuit is included.

FIG. 17 illustrates a detailed configuration example of the display driver 100 including a measurement circuit 20. The display driver 100 of FIG. 17 includes the output terminals TQ1 to TQ5, the capacitance circuits CC1 to CC5, switches SC1 to SC5, the measurement circuit 20, the control circuit 30, and the drive circuit 10. In the following description, a case where n=5 will be described as an example, but n is not limited to 5.

The measurement circuit 20 measures capacitance value information between the plurality of data lines of the electro-optical panel 200. The capacitance values of each capacitance circuit (CC1 to CC5) are set, based on the capacitance value information measured by the measurement circuit 20.

Specifically, the measurement circuit 20 measures capacitance values of parasitic capacitances CP12, CP23, CP34, CP45, and CP51 between the adjacent data lines, and acquires capacitance value information corresponding to the capacitance values. The capacitance value information may be information (data) representing the capacitance value itself, may be information for varying depending on the capacitance value, or may be information associated one-to-one with each capacitance value.

According to the present embodiment, the capacitance value of the capacitance circuit can be adjusted by measuring the capacitance value information between the data lines, based on the capacitance value information, such that the capacitances between the data lines are the same.

In addition, in the present embodiment, the measurement circuit 20 includes a comparison circuit 21 (comparator) to which a determination voltage VR (reference voltage) is input to a first input terminal (for example, a negative polarity terminal) and a switch group 22 that connects one output terminal of the plurality of output terminals TQ1 to TQ5 to a second input terminal (for example, a positive polarity terminal) of a comparison circuit 21.

Specifically, the switch group 22 includes switches SD1 to SD5. Each one terminal of the switches SD1 to SD5 is connected to the output terminals TQ1 to TQ5 and the other terminals thereof are connected to the second input terminal of the comparison circuit 21. The switches SD1 to SD5 are, for example, transistors, and are turned on or off by the control circuit 30. The determination voltage VR is supplied from, for example, a voltage generation circuit 50 of FIG. 24.

According to the present embodiment, any one output terminal is connected to a second input terminal of the comparison circuit 21 by the switch group 22, and a voltage of the output terminal is compared with the determination voltage VR. Thereby, it is possible to compare a voltage variation of the output terminal with the determination voltage VR, and to acquire capacitance value information from the comparison result.

More specifically, in a case where a voltage of the ith output terminal TQi changes, the switch group 22 connects the (i+1)th output terminal TQi+1 adjacent to the ith output terminal TQi to the second input terminal. The comparison circuit 21 compares the voltage of the (i+1)th output terminal TQi+1 with the determination voltage VR.

For example, in a case where a voltage of the output terminal TQ3 (TQi) changes, the switches SD1 to SD3 and SD 5 are turned off, the switch SD4 (SDi+1) is turned on, and the output terminal TQ4 (TQi+1) is connected to the second input terminal of the comparison circuit 21. At this time, a voltage CMI of the second input terminal becomes a voltage VQ4 of the output terminal TQ4. The comparison circuit 21 compares a voltage CMI=VQ4 with the determination voltage VR, and outputs a signal CMQ which is the comparison result to the control circuit 30. The control circuit 30 acquires capacitance value information based on the signal CMQ.

The ith output terminal and the (i+1)th output terminal may be adjacent to each other, and a sequence thereof is not limited. That is, a case where first, second, and numbers are attached to the output terminals TQ1, TQ2, . . . is described in the above description, and the embodiment is not limited to this and first, second, . . . and numbers may be attached to the output terminals TQ5, TQ4, . . . .

According to the present embodiment, in a case where the voltage of the output terminal TQi adjacent to the output terminal TQi+1 changes, the voltage variation of the output terminal TQi+1 can be compared with the determination voltage VR by the comparison circuit 21. Since a magnitude of the voltage variation of the output terminal TQi+1 changes depending on the capacitance value of the parasitic capacitance between the adjacent data lines, the capacitance value of the parasitic capacitance can be measured based on the comparison results obtained by the comparison circuit 21.

Data signals DS1 to DS5 (data voltages) from the drive circuit 10 are supplied to each one terminal of the switches SC1 to SC5, and voltages VQ1 to VQ5 of the output terminals TQ1 to TQ5 are supplied to the other terminals of the switches SC1 to SC5. In a case where switch SCi is turned on, VQi=DSi. The switches SC1 to SC5 are, for example, transistors which are turned on or off by the control circuit 30.

Figure 18:
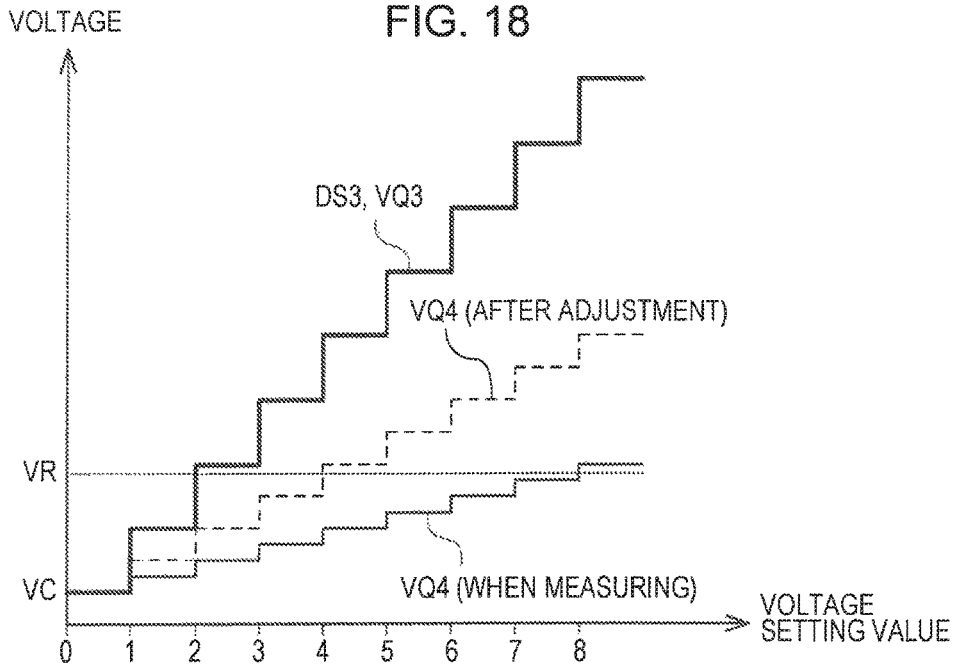
FIG. 18 is a diagram illustrating a method of measuring the capacitance value of the parasitic capacitance and a method of adjusting the capacitance value of the capacitance circuit.
Figure 19:
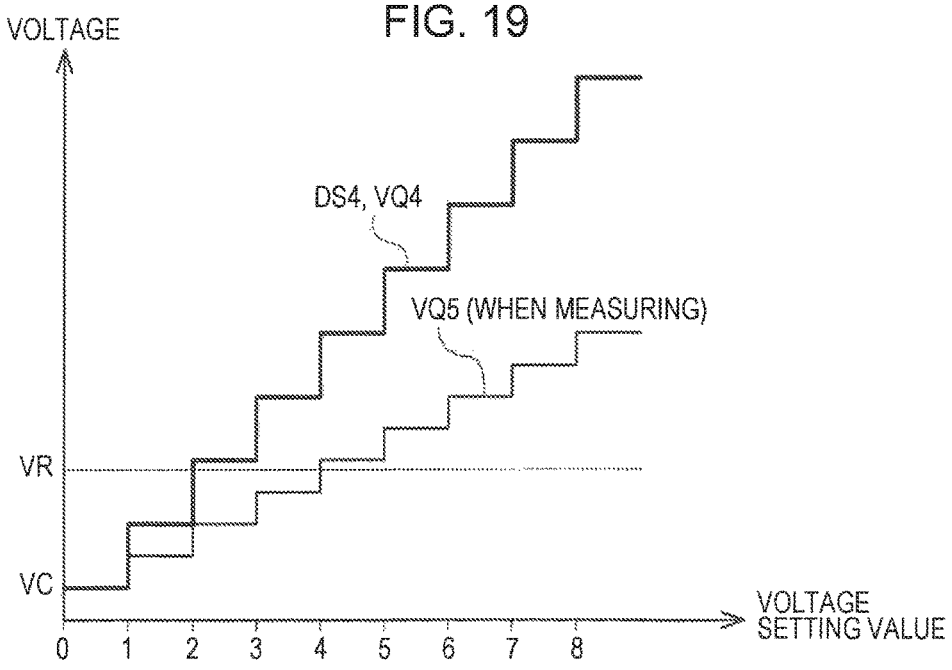
FIG. 19 is a diagram illustrating the method of measuring the capacitance value of the parasitic capacitance and the method of adjusting the capacitance value of the capacitance circuit.

FIGS. 18 and 19 are diagrams illustrating a method of measuring the capacitance value of the parasitic capacitance and a method of adjusting the capacitance value of the capacitance circuit.

FIG. 18 illustrates a voltage VQ4 of the output terminal TQ4 in a case where a voltage VQ3 of the output terminal TQ3 is changed. In this case, the switches SC1, SC3, and SC5 of FIG. 17 are turned on and the switches SC2 and SC4 are turned off. In addition, the switch SD4 is turned on, and the switches SD1 to SD3 and the switch SD5 are turned off. The drive circuit 10 gradually (stepwise) changes the voltage VQ3=DS3 with a predetermined voltage width. A voltage setting value is, for example, a count value of a counter, and the voltage VQ3=DS3 increases (or decreases) by a predetermined voltage width every time when the count value increases by 1. The voltage VQ4 is gradually changed by the parasitic capacitance CP34 between the output terminals TQ3 and TQ4, according to the change of the voltage VQ3. A voltage width of one step of the voltage variation is determined by a capacitance value of the parasitic capacitance CP34. In the example of FIG. 18, when the voltage setting value changes from 7 to 8, the voltage VQ4 is larger than the determination voltage VR, and a logic level of the output signal CMQ of the comparison circuit 21 changes (for example, changes from a low level to a high level).

FIG. 19 illustrates a voltage VQ5 of the output terminal TQ5 in a case where the voltage VQ4 of the output terminal TQ4 changes. In this case, the switches SC1, SC2, and SC4 of FIG. 17 are turned on and the switches SC3 and SC5 are turned off. In addition, the switch SD5 is turned on, and the switches SD1 to SD4 are turned off. The drive circuit 10 gradually (stepwise) changes the voltage VQ4=DS4 with a predetermined voltage width. The voltage VQ5 is gradually changed by the parasitic capacitance CP45 between the output terminals TQ4 and TQ5, according to the change of the voltage VQ4. In the example of FIG. 19, when the voltage setting value changes from 3 to 4, the voltage VQ5 is larger than the determination voltage VR, and the logic level of the output signal CMQ of the comparison circuit 21 changes.

For example, it is assumed that the capacitance value of CP45 of the parasitic capacitances CP12, CP23, CP34, CP45, and CP51 is maximum. In this case, the logic level of the output signal CMQ of the comparison circuit 21 is changed by the voltage setting value (4 in the example of FIG. 19) in which the voltage VQ5 is minimum in a case where the voltage VQ4 is changed. As illustrated in FIG. 18, when the capacitance value of the capacitance circuit CC3 is adjusted, the voltage VQ4 in a case where the voltage VQ3 is changed sets the capacitance value of the capacitance circuit CC3 such that a logic level of the output signal CMQ of the comparison circuit 21 is changed by the minimum voltage setting value (4). By performing the adjustment, the total sum of the capacitance values of the parasitic capacitance CP34 and the capacitance circuit CC3 is approximately equal to a maximum capacitance value of the parasitic capacitance CP45. The same adjustment is also performed for the capacitance circuits CC1, CC2, and CC5. The capacitance circuit CC4 does not vary from, for example, a predetermined capacitance value (for example, 0) set at the time of measurement.

Figure 20:
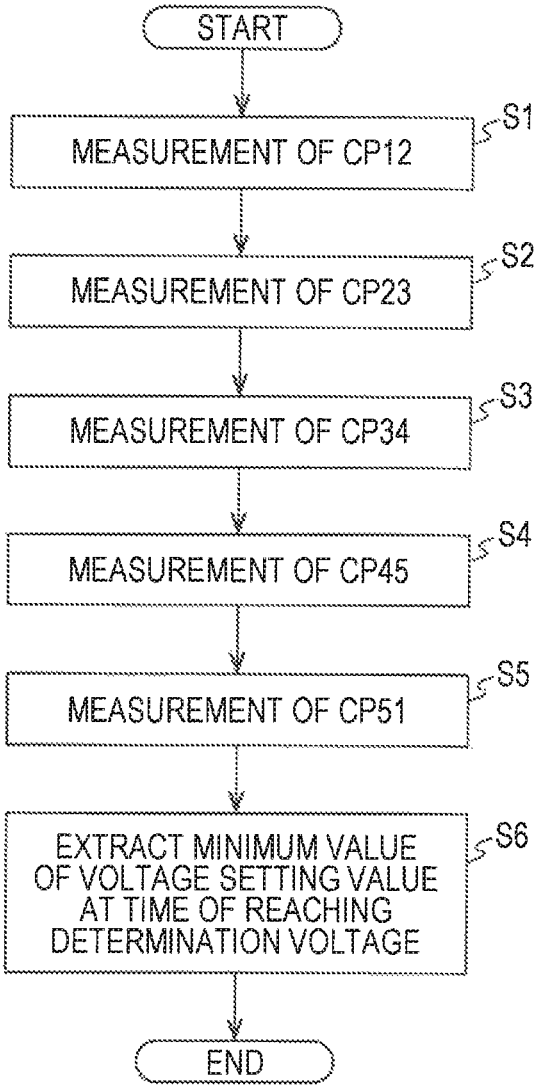
FIG. 20 is a flowchart of processing of measuring the capacitance value of the parasitic capacitance.

FIG. 20 is a flowchart of processing of measuring the capacitance value of the parasitic capacitance. If the processing starts, the measurement circuit 20 and the control circuit 30 sequentially measure the capacitance values of the parasitic capacitances CP12, CP23, CP34, CP45, and CP51 (S1 to S5). That is, the control circuit 30 acquires a voltage setting value (voltage setting value when the logic level of the output signal CMQ of the comparison circuit 21 changes) when a voltage of the output terminal reaches the determination voltage VR, for each parasitic capacitance. A measurement sequence of the parasitic capacitances CP12, CP23, CP34, CP45, and CP51 is not limited to this, and may be in any sequence. Next, the control circuit 30 extracts a minimum value, which is acquired for each parasitic capacitance, among the voltage setting values obtained when the voltage of the output terminal reaches the determination voltage VR (S6).

Figure 21:
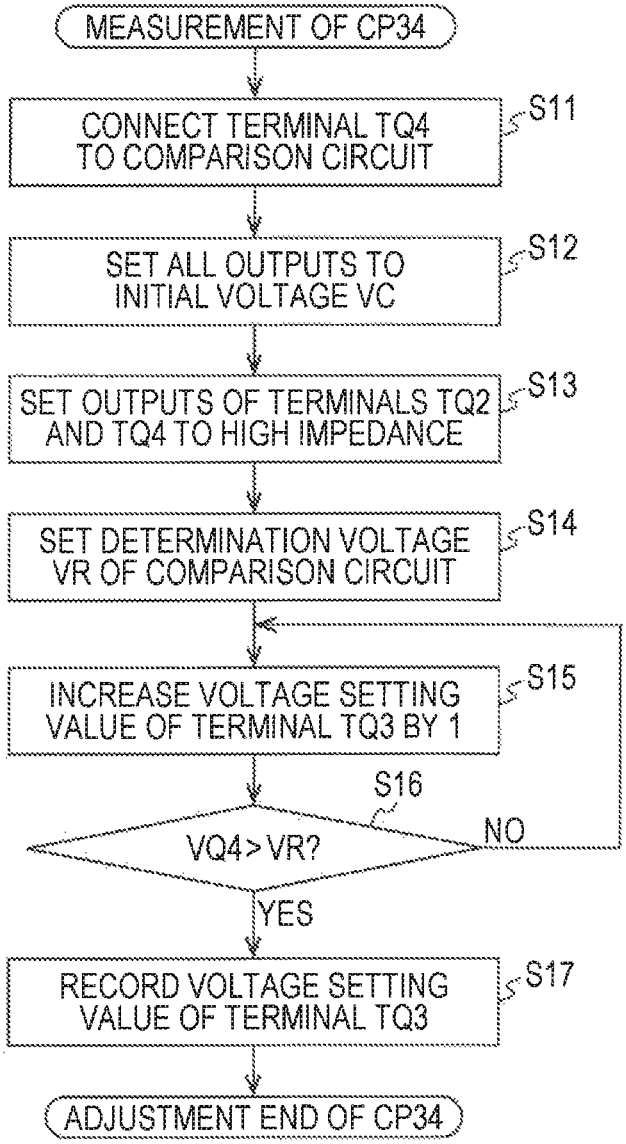
FIG. 21 is a detailed flowchart of the processing of measuring the capacitance value of the parasitic capacitance.
Figure 24:
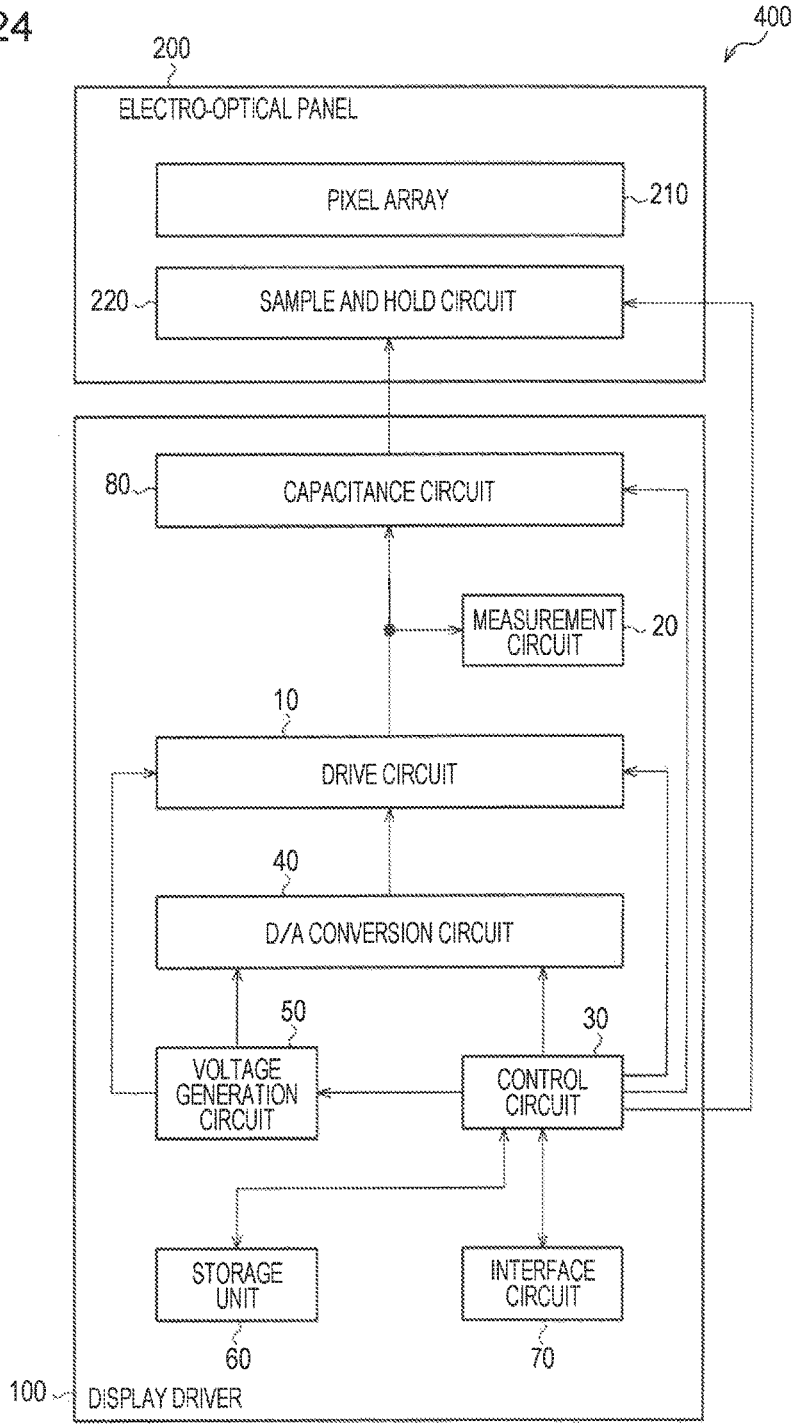
FIG. 24 is a configuration example of an electro-optical device.

FIG. 21 is a detailed flowchart of the processing (S3) of measuring the capacitance value of the parasitic capacitance CP34. The capacitance values of the parasitic capacitances CP12, CP23, CP45, and CP51 can also be measured by the same processing. If the processing starts, the control circuit 30 connects the output terminal TQ4 to the comparison circuit 21 (S11). That is, the control circuit 30 turns on the switch SD4. Next, the drive circuit 10 sets all the outputs to an initial voltage VC (S12). That is, the control circuit 30 turns on the switches SC1 to SC5, and the drive circuit 10 outputs the initial voltage VC as the data signals DS1 to DS5. The initial voltage VC is, for example, a common voltage supplied to a common electrode of the electro-optical panel 200. Next, the control circuit 30 sets the outputs of the output terminals TQ2 and TQ4 to high impedance (S13). That is, the control circuit 30 turns off the switches SC2 and SC4. Next, the determination voltage VR of the comparison circuit 21 is set (S14). For example, the determination voltage VR from the voltage generation circuit 50 of FIG. 24 is input to the first input terminal of the comparison circuit 21 in accordance with selection of a selector or the like.

Next, the control circuit 30 increases the voltage setting value of the output terminal TQ3 by 1 (S15). That is, the control circuit 30 increases the voltage setting value of the output terminal TQ3 by +1, and the drive circuit 10 outputs the voltage VQ3=DS3 according to the voltage setting value. For example, the initial value of the voltage setting value is zero, and the initial value is the voltage VQ3=VC. The change of the voltage setting value in step S15 is not limited to +1, and the voltage setting value may vary such that the voltage VQ3 gradually increases (or decreases). Next, the comparison circuit 21 determines whether or not the voltage VQ4 of the output terminal TQ4 is larger than the determination voltage VR (S16). In a case where it is determined that the voltage VQ4 is lower than or equal to the determination voltage VR, the control circuit 30 increases the voltage setting value of the output terminal TQ3 by 1 (S15). Meanwhile, in a case where it is determined that the voltage VQ4 is larger than the determination voltage VR, the control circuit 30 records the voltage setting value of the output terminal TQ3 at that time (S17).

Figure 22:
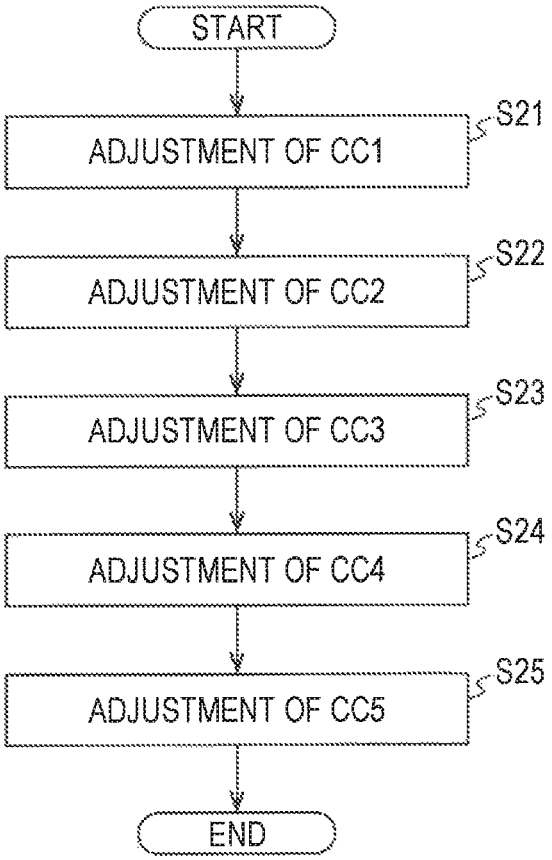
FIG. 22 is a flowchart of processing of adjusting the capacitance value of the capacitance circuit.

FIG. 22 is a flowchart of the processing of adjusting the capacitance value of the capacitance circuit. If the processing starts, the control circuit 30 sequentially adjusts the capacitance values of the capacitance circuits CC1, CC2, CC3, CC4, and CC5 (S21 to S25). The adjustment sequence of the capacitance values of the capacitance circuits CC1, CC2, CC3, CC4, and CC5 is not limited to this, and may be in any sequence.

Figure 23:
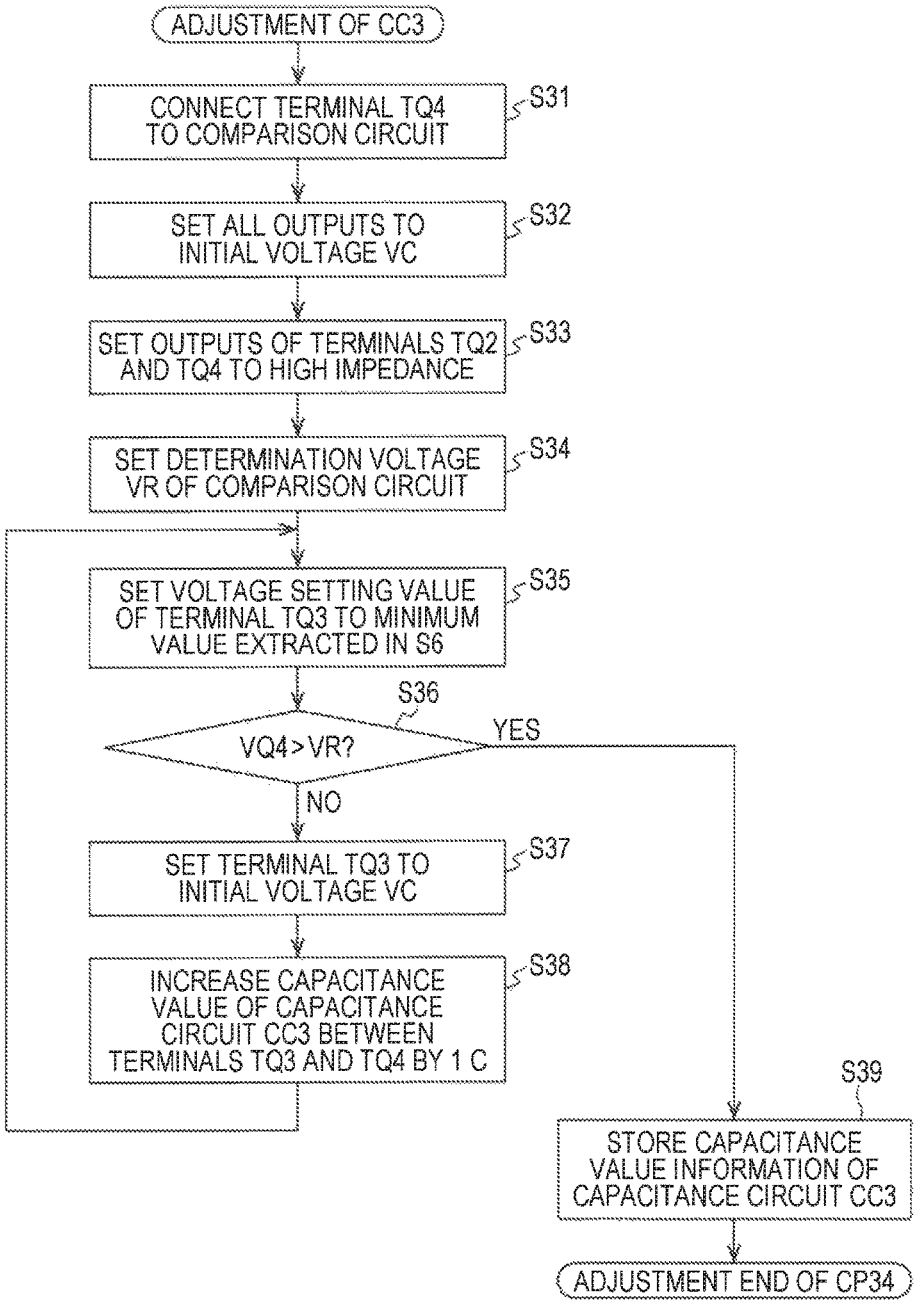
FIG. 23 is a detailed flowchart of the processing of adjusting the capacitance value of the capacitance circuit.

FIG. 23 is a detailed flowchart of the processing (S23) of adjusting the capacitance value of the capacitance circuit CC3. The capacitance values of the capacitance circuits CC1, CC2, CC4, and CC5 can also be adjusted by the same processing. If the processing starts, the control circuit 30 connects the output terminal TQ4 to the comparison circuit 21 (S31). That is, the control circuit 30 turns on the switch SD4. Next, the drive circuit 10 sets all the outputs to the initial voltage VC (S32). That is, the control circuit 30 turns on the switches SC1 to SC5, and the drive circuit 10 outputs the initial voltage VC as the data signals DS1 to DS5. Next, the control circuit 30 sets the outputs of the output terminals TQ2 and TQ4 to high impedance (S33). That is, the control circuit 30 turns off the switches SC2 and SC4. Next, the determination voltage VR of the comparison circuit 21 is set (S34). For example, the determination voltage VR from the voltage generation circuit 50 of FIG. 24 is input to the first input terminal of the comparison circuit 21 in accordance with selection of a selector or the like.

Next, the control circuit 30 sets the voltage setting value of the output terminal TQ3 to a minimum value extracted in step S6 (S35). That is, the control circuit 30 changes the voltage setting value (for example, 0) corresponding to the initial voltage VC to the minimum value (4 in the example of FIG. 19) extracted in step S6, and the drive circuit 10 outputs a voltage VQ3=DS3 according to the voltage setting value. Next, the comparison circuit 21 determines whether or not the voltage VQ4 of the output terminal TQ4 is higher than the determination voltage VR (S36). In a case where it is determined that the voltage VQ4 is lower than or equal to the determination voltage VR, the drive circuit 10 sets the output terminal TQ3 to the initial voltage VC (S37). Next, the control circuit 30 increases the capacitance value of the capacitance circuit CC3 between the output terminals TQ3 and TQ4 by 1C (S38) and the processing returns to step S35. The initial value of the capacitance value is, for example, 0 C. Meanwhile, in a case where it is determined that the voltage VQ4 is higher than the determination voltage VR in step S36, the control circuit 30 stores the capacitance value of the capacitance circuit CC3 at that time (S39).

For example, there is a method of adjusting a capacitance value of a capacitance circuit by measuring only capacitance values of some parasitic capacitances as a modified example of the measuring method and the adjusting method, as will be described below. That is, as described with reference to FIG. 5, the capacitance values of the parasitic capacitances are sequentially increased and decreased, and a magnitude ratio thereof is approximately the same. Hence, a parasitic capacitance with a small capacitance value and a parasitic capacitance with a large capacitance value are measured one by one (for example, S1, S2, and S6 of FIG. 20 are executed to measure CP12 and CP23). Next, the capacitance value of the capacitance circuit corresponding to the parasitic capacitance with a small capacitance value is adjusted so as to match the parasitic capacitance with a large capacitance value (for example, in a case where CP12<CP23, S21 of FIG. 22 is performed to adjust the capacitance value of CC1). The capacitance circuit corresponding to other data lines with a small capacitance value of the parasitic capacitance is also set to the same capacitance value (for example, in a case where CP34 and CP51 are smaller than CP23 and CP45, the capacitance values of CC3 and CC5 are set to be equal to the capacitance value CC1).

6. Electro-Optical Device

FIG. 24 illustrates a configuration example of the electro-optical device 400 (display device) including the display driver 100 according to this embodiment. The electro-optical device 400 includes the display driver 100 and the electro-optical panel 200. The display driver 100 includes the drive circuit 10, the measurement circuit 20, the control circuit 30, the D/A conversion circuit 40, the voltage generation circuit 50, a storage unit 60 (memory), an interface circuit 70, and a capacitance circuit 80. The electro-optical panel 200 includes a pixel array 210 and a sample and hold circuit 220. The capacitance circuit 80 corresponds to the capacitance circuits CC1 to CCn of FIG. 15 and the like. The pixel array 210 formed by arranging a plurality of pixels of FIG. 3 in an array. The sample and hold circuit 220 corresponds to the transistors TR1, TR2, TR3, . . . of FIG. 3.

Figure 25:
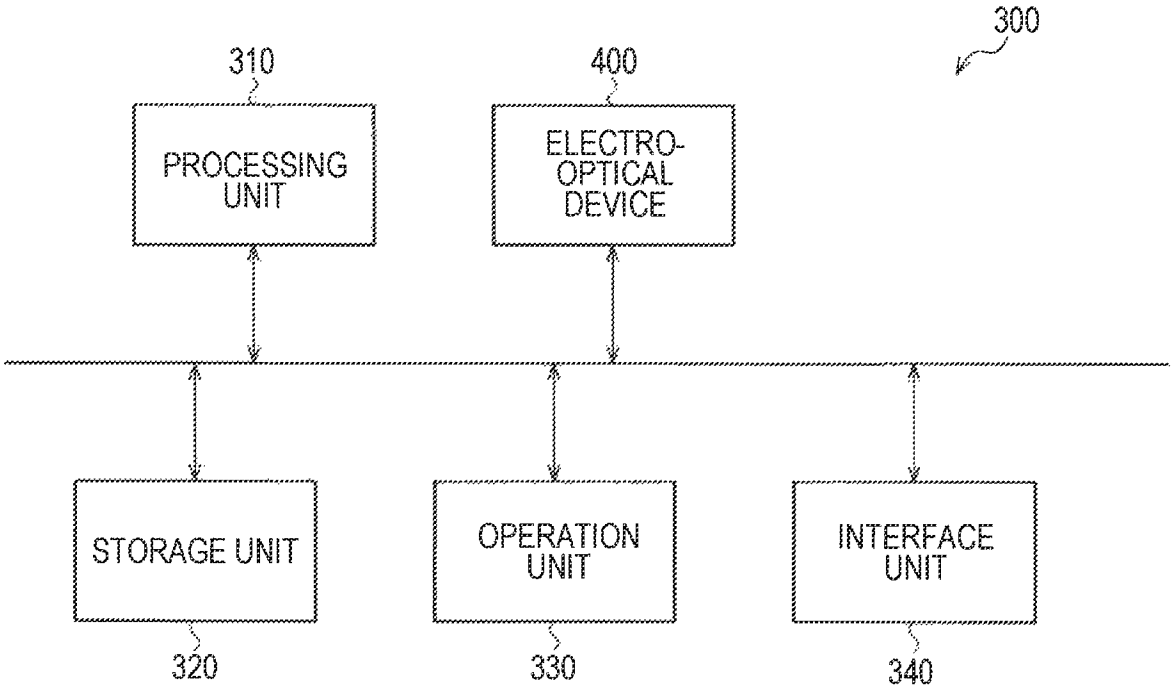
FIG. 25 is a configuration example of an electronic apparatus.

The interface circuit 70 performs communication between the display driver 100 and an external processing device (for example, a processing unit 310 of FIG. 25). For example, a clock signal or display data is input from the external processing device to the control circuit 30 through the interface circuit 70.

The control circuit 30 controls each unit of the display driver 100 on the basis of the clock signal or the display data input through the interface circuit 70. For example, the control circuit 30 selects horizontal scan lines of the pixel array 210 or controls display timing of vertical synchronization control and the like of the pixel array 210, and controls the drive circuit 10 in accordance with the display timing.

The voltage generation circuit 50 generates various voltages and outputs the voltages to the drive circuit 10 or the D/A conversion circuit 40. For example, the voltage generation circuit 50 includes a gradation voltage generation circuit (for example, ladder resistors) which generates a plurality of voltages, a power supply circuit which generates power supply of an amplification circuit of the drive circuit 10, a voltage generation circuit which generates the determination voltage VR of the measurement circuit 20, and the like.

The D/A conversion circuit 40 performs D/A conversion of the display data from the control circuit 30, and outputs the converted voltage to the drive circuit 10. That is, a voltage corresponding to the display data is selected among a plurality of voltages supplied from the gradation voltage generation circuit of the voltage generation circuit 50, and the selected voltage is output to the drive circuit 10.

The storage unit 60 stores various types of data (for example, setting data) and the like used for controlling the display driver 100. For example, the storage unit 60 is configured with a nonvolatile memory or RAM (SRAM, DRAM, and the like).

7. Electronic Apparatus

FIG. 25 is a configuration example of an electronic apparatus 300 including the display driver 100 according to the embodiment. There may be various types of electronic apparatuses in which display devices are mounted, such as a projector or a head mount display, a portable information terminal, an in-vehicle device (for example, a meter panel, a car navigation system, and the like), a portable game terminal, and an information processing device, as a specific example of the electronic apparatus 300.

The electronic apparatus 300 includes a processing unit 310 (for example, a processor such as a CPU, or a gate array), a storage unit 320 (for example, a memory, a hard disk, or the like), an operation unit 330 (an operation device), an interface unit 340 (an interface circuit or an interface device), and the electro-optical device 400 (display). The electro-optical device 400 includes the display driver 100 and the electro-optical panel 200 as illustrated in FIG. 24.

The operation unit 330 is a user interface that receives various operations from a user. For example, the operation unit includes buttons, a mouse, a keyboard, a touch panel mounted on the electro-optical device 400 (electro-optical panel 200), and the like. The interface unit 340 is a data interface which receives and outputs image data or control data. For example, the interface unit includes a wired communication interface such as a USB, or a wireless communication interface such as a wireless LAN. The storage unit 320 stores data input from the interface unit 340. Alternatively, the storage unit 320 functions as a working memory of the processing unit 310. The processing unit 310 processes display data input from the interface unit 340 or stored in the storage unit 320, and transfers the processed display data to the electro-optical device 400 (display driver 100). The electro-optical device 400 displays an image on a pixel array on the basis of the display data transferred from the processing unit 310.

The present embodiment is described in detail as above, and it will be easily understood by those skilled in the art that many modifications can be made without practically departing from novel matters and effects of the invention. Hence, all the modifications are included in the scope of the invention. For example, a term described together with another term that is broader or equivalent at least once in the specification or drawings, can be replaced with a term different from the term at any position of the specification or the drawings. In addition, all combinations of the present embodiment and modification examples are also included in the scope of the invention. In addition, configurations and operations of the display driver, the electro-optical panel, the electro-optical device, the electronic apparatus, and the like are not limited to the description of the present embodiment, and various modifications can be made.

The entire disclosure of Japanese Patent Application No. 2016-157266, filed Aug. 10, 2016 is expressly incorporated by reference herein.

What is claimed is:

1. A display driver comprising:

a plurality of output terminals that output a plurality of data signals which are output to an electro-optical panel; and a drive circuit that outputs the plurality of data signals to the plurality of output terminals, the drive circuit including a plurality of drive units, each of the plurality of drive units including:

an amplification circuit; and a drive assistance circuit that assists drive which is performed by the amplification circuit, and wherein:

a drive assistance capability of the drive assistance circuit of an ith drive unit of the plurality of drive units changes based on whether a direction of a gradation change of a drive unit that is different from and is adjacent to the ith drive unit is same or different from a direction of a gradation change of the ith drive unit.

2. The display driver according to claim 1, the drive assistance capability of the drive assistance circuit of the ith drive unit decreases, in a case where the direction of the gradation change of the drive unit that is different from and is adjacent to the ith drive unit is the same as the direction of the gradation change of the ith drive unit.

3. The display driver according to claim 1, the drive assistance capability of the drive assistance circuit of the ith drive unit increases, in a case where the direction of the gradation change of the drive unit that is different from and is adjacent to the ith drive unit is different from the direction of the gradation change of the ith drive unit.

4. The display driver according to claim 1, the drive assistance circuit of the ith drive unit assists drive in accordance with the direction of the gradation change of the drive unit that is different from and is adjacent to the ith drive unit, in a case where the gradation change of the ith drive unit is zero.

5. The display driver according to claim 1, the drive assistance capability of the drive assistance circuit of the ith drive unit changes on the basis of a total sum of gradation change information of the plurality of drive units.

6. The display driver according to claim 5, the drive assistance capability of the drive assistance circuit of the ith drive unit decreases, in a case where a direction of a gradation change that is represented by the total sum of the gradation change information of the plurality of drive units is the same as the direction of the gradation change of the ith drive unit.

7. The display driver according to claim 5, the drive assistance capability of the drive assistance circuit of the ith drive unit increases, in a case where a direction of a gradation change that is represented by the total sum of the gradation change information of the plurality of drive units is different from the direction of the gradation change of the ith drive unit.

8. The display driver according to claim 5, the drive assistance circuit of the ith drive unit assists drive in accordance with a direction of a gradation change that is represented by the total sum information of the gradation change information of the plurality of drive units, in a case where the gradation change of the ith drive unit is zero.

9. The display driver according to claim 1, wherein:

the drive assistance circuit assists such that an output of the drive circuit for the ith drive unit changes to a high potential side power supply voltage direction, in a case where the direction of the gradation change of the ith drive unit is the high potential side power supply voltage direction; and the drive assistance circuit assists such that the output of the drive circuit for the ith drive unit changes to a low potential side power supply voltage direction, in a case where the direction of the gradation change of the ith drive unit is the low potential side power supply voltage direction.

10. The display driver according to claim 9, wherein:

the drive assistance circuit includes a first drive transistor group on the high potential side power supply voltage side and a second drive transistor group on the low potential side power supply voltage side; and the drive assistance circuit changes drive capability of the first drive transistor group, in a case where the direction of the gradation change of the ith drive unit is the high potential side power supply voltage direction, and changes drive capability of the second drive transistor group, in a case where the direction of the gradation change of the ith drive unit is the low potential side power supply voltage direction.

11. The display driver according to claim 1, the drive assistance circuit performs a preliminary drive before being driven by the amplification circuit.

12. The display driver according to claim 1, further comprising:

a control circuit that:

performs calculation processing based on whether the direction of the gradation change of the drive unit that is different from and is adjacent to the ith drive unit is the same or different from the direction of the gradation change of the ith drive unit; and sets the drive assistance capability of the drive assistance circuit.

13. The display driver according to claim 1, wherein:

the electro-optical panel includes a sample and hold circuit that samples and holds a plurality of video signals which are the plurality of data signals; and the plurality of output terminals are connectable to one terminal of the sample and hold circuit.

14. An electro-optical device comprising:

the display driver according to claim 1; and the electro-optical panel.

15. The electro-optical device according to claim 14, wherein:

the electro-optical panel includes a sample and hold circuit that samples and holds a plurality of video signals which are the plurality of data signals, and a plurality of input terminals that are connected to the plurality of output terminals of the display driver;

the sample and hold circuit includes a plurality of transistors, each having a drain that is connected to a pixel and a source that is connected to any one input terminal of the plurality of input terminals; and the plurality of transistors include a first transistor having a first source and a first drain which are arranged in this sequence in a first direction of the electro-optical panel, and a second transistor that is adjacent to the first transistor in the first direction and has a second source and a second drain which are arranged in this sequence in the first direction.

16. An electronic apparatus comprising:

the display driver according to claim 1.

17. A display driver which outputs a data voltage according to display data to an electro-optical panel, the display driver comprising:

a first drive circuit that outputs a first data voltage in accordance with first display data;

a second drive circuit that outputs a second data voltage in accordance with second display data;

a first output terminal that is electrically connected to a first data line of the electro-optical panel and outputs the first data voltage; and a second output terminal that is electrically connected to a second data line of the electro-optical panel which is adjacent to the first data line, and outputs the second data voltage, wherein:

the first drive circuit includes a first amplification circuit and a first drive assistance circuit that assists drive which is performed by the first amplification circuit;

the second drive circuit includes a second amplification circuit and a second drive assistance circuit that assists drive which is performed by the second amplification circuit; and a drive assistance capability of the first drive assistance circuit changes based on whether a direction of a gradation change of the second drive circuit is same or different from a direction of a gradation change of the first drive circuit.

18. An electronic apparatus comprising:

the display driver according to claim 17.

* * * * *